US005816001A

United States Patent [19]

Goodman et al.

[11] Patent Number: 5,816,001

[45] Date of Patent: Oct. 6, 1998

[54] PARTITION CONSTRUCTION INCLUDING INTERCONNECTION SYSTEM AND REMOVABLE COVERS

[75] Inventors: Steven F. Goodman, Wyoming; Michael J. Feldpausch; Jeffrey A. Musculus, both of Hastings, all of Mich.

[73] Assignee: Steelcase Inc., Grand Rapids, Mich.

[21] Appl. No.: 687,724

[22] Filed: Jul. 26, 1996

[51] Int. Cl.[6] ..... E04B 2/78; E04B 2/82

[52] U.S. Cl. ..... 52/239; 52/36.1; 52/36.6; 52/220.7; 52/284; 52/481.2; 52/489.2; 52/653.1

[58] Field of Search ..... 52/36.1, 36.4, 52/36.5, 36.6, 220.7, 239, 281, 284, 474, 479, 481.1, 481.2, 483.1, 489.1, 489.2, 653.1, 656.1, 775, 781; 108/106, 107, 108; 312/265.2, 265.3

[56] References Cited

U.S. PATENT DOCUMENTS

| | | | |
|---|---|---|---|
| 3,101,817 | 8/1963 | Radek | 52/36.6 X |
| 3,408,127 | 10/1968 | Vincens . | |
| 3,733,755 | 5/1973 | Butler | 52/479 X |
| 3,802,146 | 4/1974 | Tacke et al. . | |
| 4,185,422 | 1/1980 | Radek | 52/36.6 |
| 4,423,573 | 1/1984 | Omholt et al. . | |
| 4,535,577 | 8/1985 | Tenser et al. . | |
| 4,631,881 | 12/1986 | Charman . | |
| 4,685,255 | 8/1987 | Kelley | 52/36.1 |
| 4,731,960 | 3/1988 | Sease . | |
| 5,062,246 | 11/1991 | Sykes . | |
| 5,134,826 | 8/1992 | La Roche et al. | 52/281 X |
| 5,142,832 | 9/1992 | Branham, Sr. et al. . | |
| 5,175,969 | 1/1993 | Knauf et al. . | |
| 5,209,035 | 5/1993 | Hodges et al. | 52/220.7 |
| 5,287,666 | 2/1994 | Frascaroli et al. . | |
| 5,309,686 | 5/1994 | Underwood et al. . | |
| 5,394,658 | 3/1995 | Schreiner et al. . | |
| 5,400,560 | 3/1995 | Hellwig et al. . | |
| 5,406,760 | 4/1995 | Edwards . | |
| B1 4,876,835 | 6/1992 | Kelly et al. . | |

OTHER PUBLICATIONS

Progetto 25.90 by Unifor, Inc. U.S.A., Long Island City, New York (35 pgs), date unknowno—prior to Jan. 1, 1991.

Panneli PL by Unifor, Inc. U.S.A., Long Island City, New York (35 pgs), date unknown—prior to filing date of present application.

Teknion –Office Furniture Systems 440905 Price List (31 pgs), Apr. 1983.

*Primary Examiner*—Carl D. Friedman
*Assistant Examiner*—Kevin D. Wilkens
*Attorney, Agent, or Firm*—Price, Heneveld, Cooper, DeWitt & Litton

[57] ABSTRACT

A partition construction includes a partition frame having opposing vertical edges and upper and lower frame members each defining a repeating pattern of configured apertures and holes extending horizontally between its vertical side edges. The configured apertures are "+" or "T" shaped, and include at least a smaller lower section and an enlarged middle section. Cover panels are attachable to the partition frame by top locator/connectors that engage the smaller lower section of selected apertures in the upper frame member, and by bottom connectors that engage an upper one of the holes in the lower frame member. The cover panels are shaped to leave the enlarged middle section of the configured apertures open, so that they can receive a component-supporting bracket or an off-module partition supporting bracket to the primary partition frame. A U-shaped "off-module" connector is provided having a pair of hooked legs for engaging a selected one of the apertures in the enlarged middle section thereof, and a rear section configured for connection to the end of an off-module partition frame. The partition frame includes a pair of leveling members each including downwardly disposed end sections. A floor channel is provided having a locking wall spaced above a floor-engaging wall. The locking wall includes key hole apertures having a large end for vertically receiving the end sections of the leveling members and further having a small end for horizontally receiving the end sections of the leveler. The locking wall includes marginal material around the small end for engaging a recess on the end sections of the leveler to retain the leveler in the key hole apertures.

22 Claims, 27 Drawing Sheets

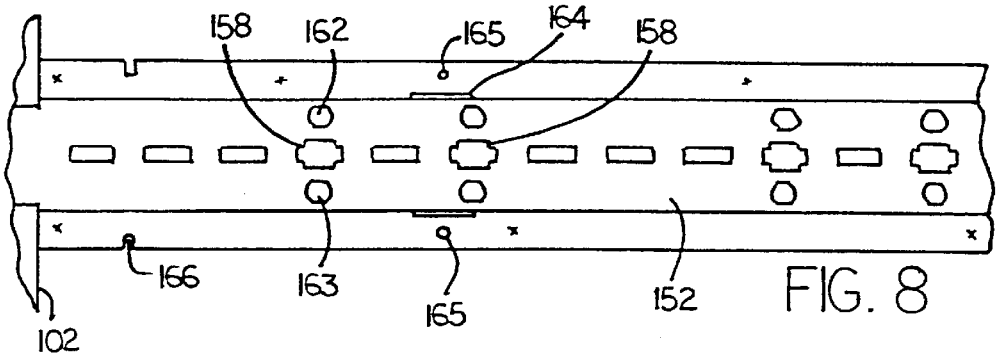
FIG. 8
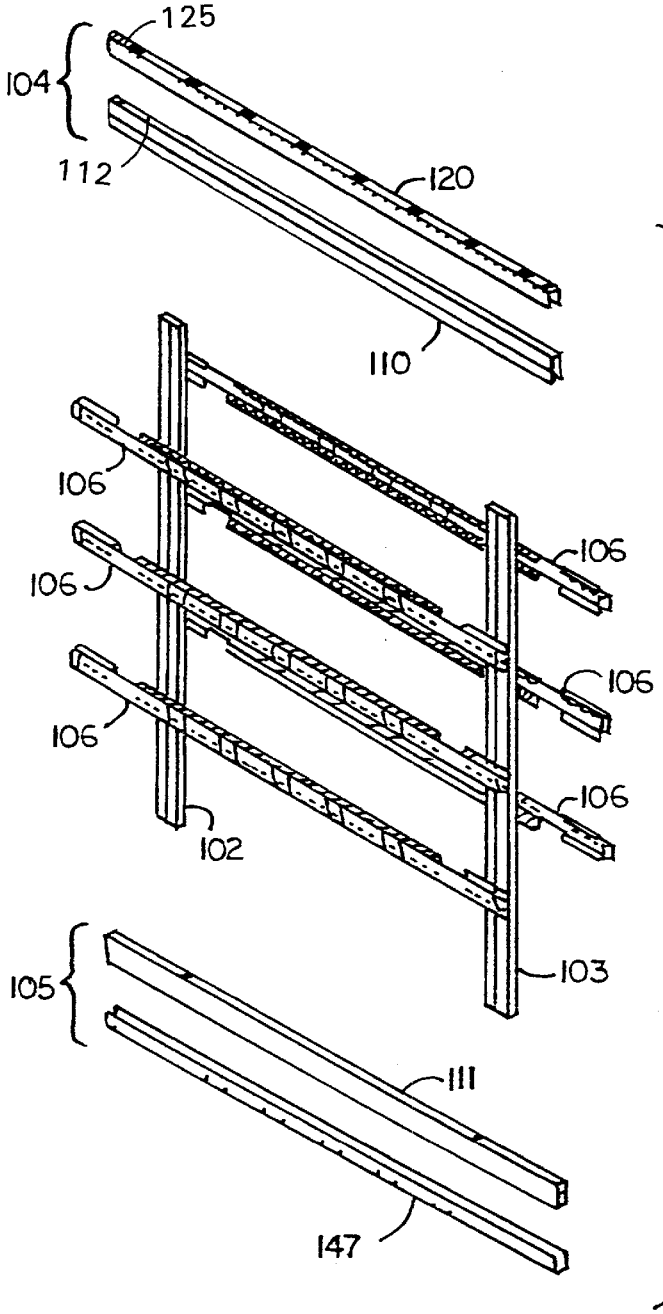
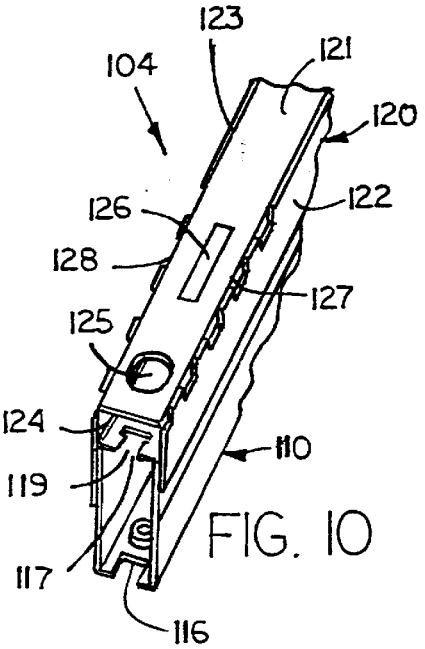
FIG. 10
FIG. 9

169
170
171
172
173
174
175
176
177
178
179
180
181
182
184
185
185'
186
187
188
191
192
194
195
196
197
198
198'
198"
199
202
203
A 101
108
106
210
324
323
322
288
163
286
290
292
275
276

101
108

286'
325
276'
107
279
293
291
287
289
162
282
210'
302
107
326
287'

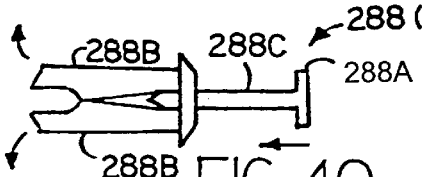
FIG. 40
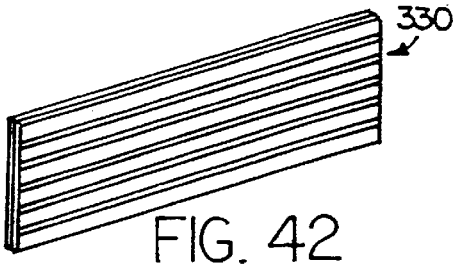
FIG. 42
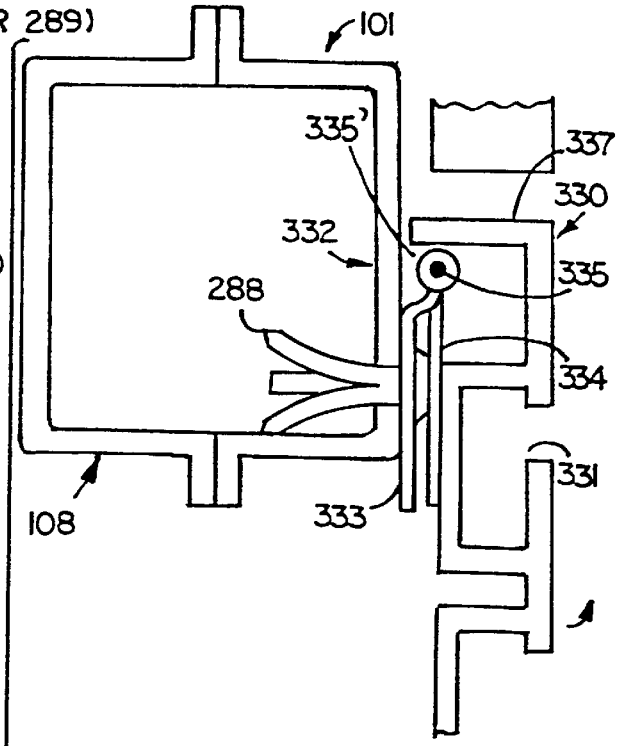
FIG. 43
FIG. 45
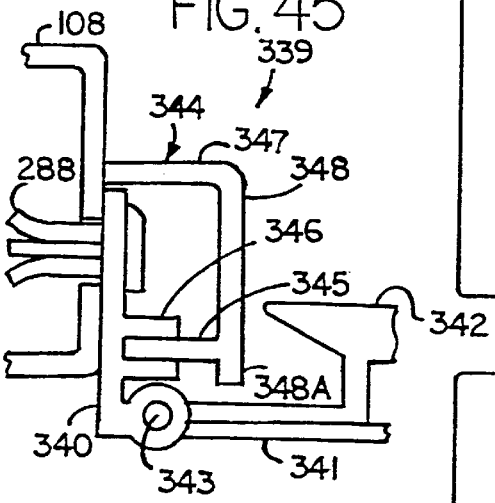
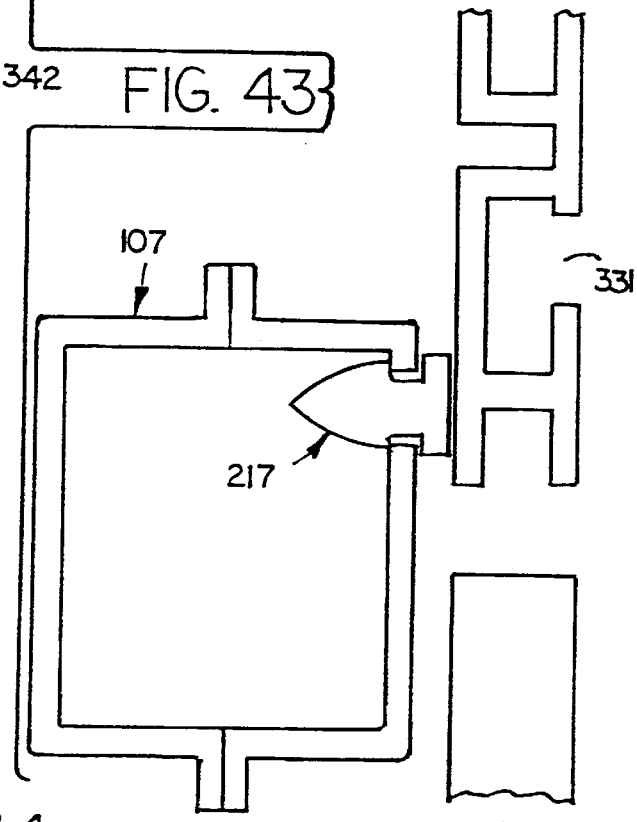
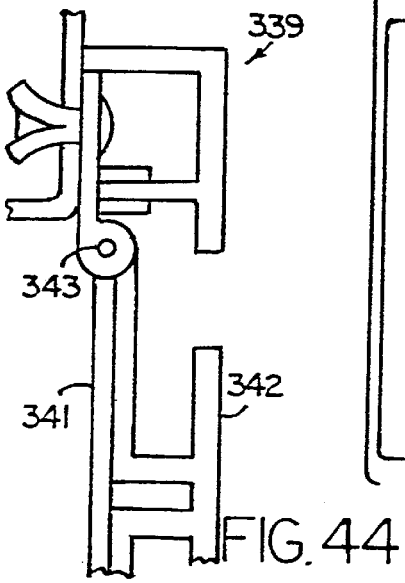
FIG. 44

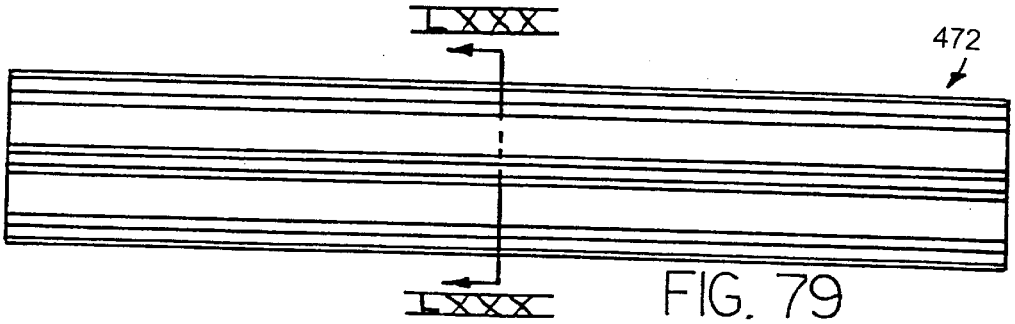
FIG. 79
FIG. 80
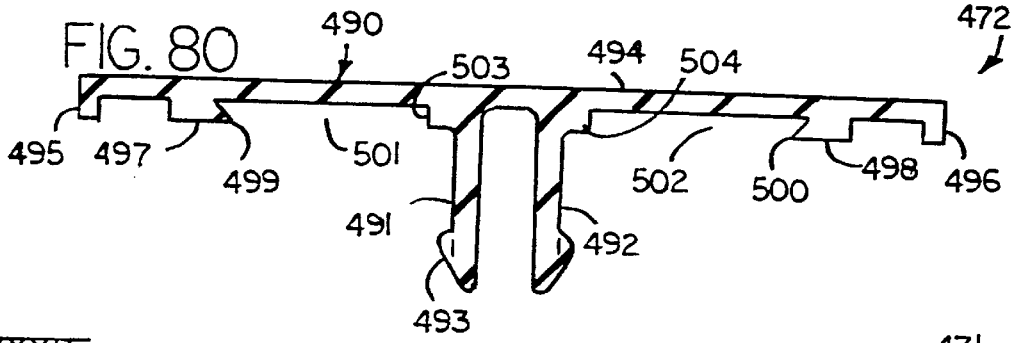
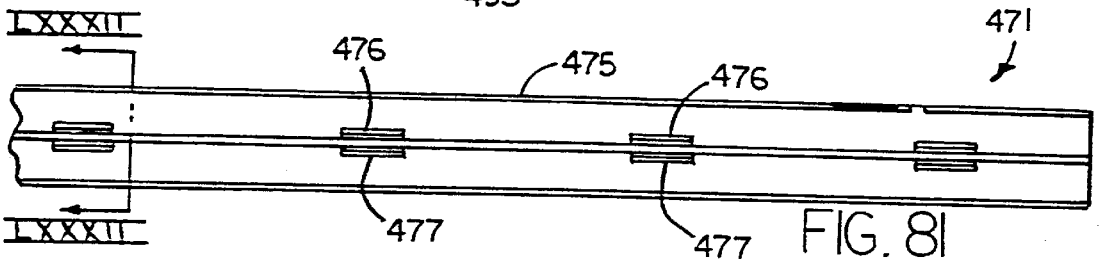
FIG. 81
FIG. 82
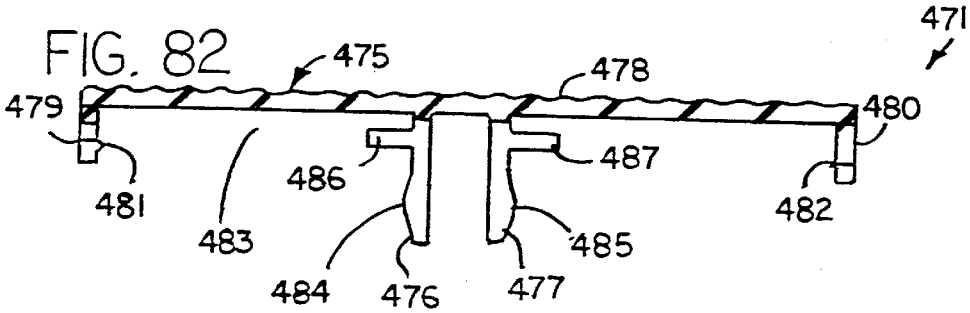

FIG. 83
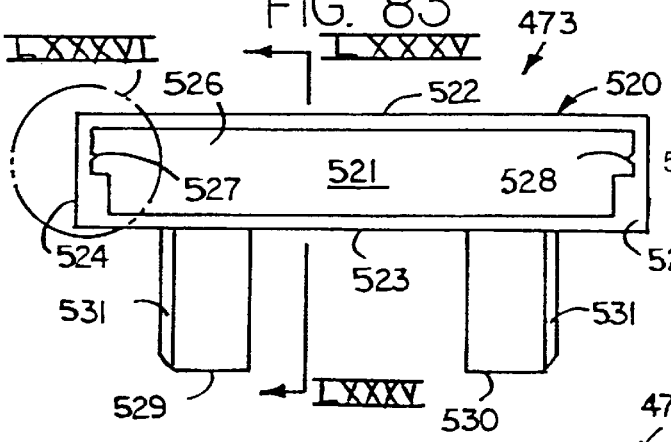
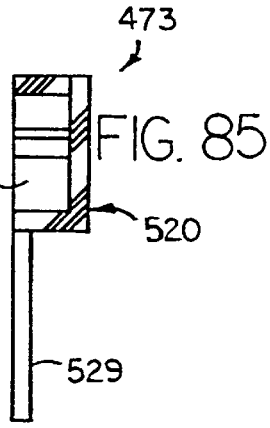
FIG. 85
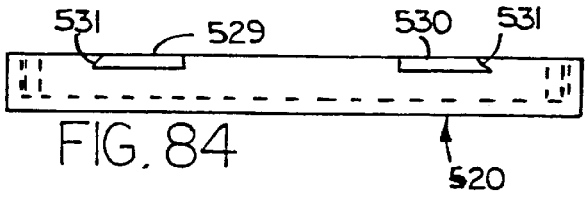
FIG. 84
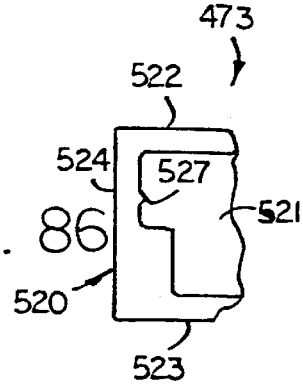
FIG. 86
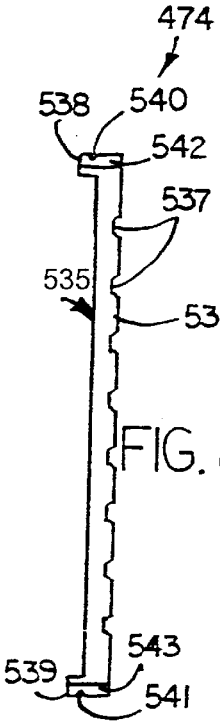
FIG. 87
FIG. 88
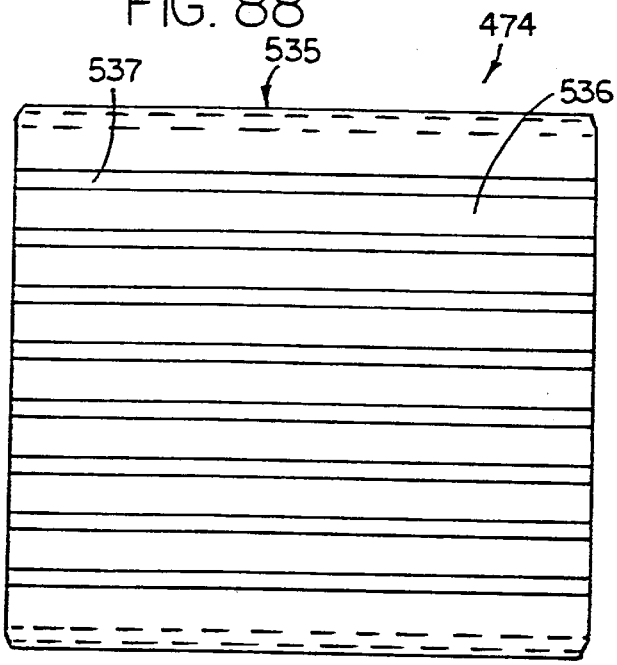

PARTITION CONSTRUCTION INCLUDING INTERCONNECTION SYSTEM AND REMOVABLE COVERS

CROSS REFERENCE TO RELATED APPLICATIONS

This application is related to the following coassigned applications.

| Ser. No. | Filing date | Title |
|---|---|---|
| 367,802 | 12/30/94 | PORTABLE PARTITION SYSTEM |
| 367,804 | 12/30/94 | INTEGRATED PREFABRICATION FINISH SYSTEM FOR BUILDING SPACE |
| 579,614 | 12/26/95 | PARTITION SYSTEM |
| 686,913 | 07/26/96 | PARTITION CONSTRUCTION AND TRIM SYSTEM THEREFORE |
| 686914 | 07/26/96 | PARTITION CONSTRUCTION WITH MODULAR FOOTPRINT |
| 686701 | 7/26/96 | CONNECTION SYSTEM FOR CONNECTING PARTITION TO FLOOR CHANNEL |

BACKGROUND OF THE INVENTION

The present invention concerns a reconfigurable partition system including a panel-to-panel connection system that facilitates quick and accurate interconnection of partition panels, including off-module partition panels connected in T-shaped plan arrangements. Further, the present invention concerns removable trim for the partition system having an architectural appearance, and also concerns removable cover panels having connectors that cooperate with the panel-to-panel connection system to flexibly support cover panels on the partition panels.

Many partition frames include vertical side frame members that define a vertically disposed row of slots on their face at their vertical side edges. The slots are configured to receive brackets to support other partition frames and/or to support furniture components such as shelves, bookbinders, worksurfaces, and the like. These partition systems are called "on-module" partition systems herein, because the attachment slots are only located "on-module" at the vertical side edges of the partition frames. Disadvantageously, when "on-module" partition systems are arranged into workstations, the location of the vertical slots at the vertical side edges drives the location of partition-mounted furniture components. Disadvantageously, this can prevent a workstation from being arranged in a preferred/optimal arrangement. Still further, as the size of a workspace is reduced, the ability to custom locate and arrange furniture and accessories becomes increasingly important for spacial reasons and personal reasons, as well as job efficiency.

The term "off-module" partition panel is used herein to mean a partition panel arrangement wherein a first partition panel is positioned abuttingly against a side of a second partition panel at an intermediate location between the vertical side edges of the second partition panel in a "T" shaped plan arrangement. The first partition panel is "off-module" since its vertical side edge does not connect to a vertical side edge of the second partition panel. "Off-module" partition constructions advantageously allow a user to configure the workspaces in customized optimal shapes and sizes. But "off-module" positioning of partition panels results in the "on-module" vertical rows of slots at the vertical side edges of the panel being positioned on opposite sides of the "off-module" partition panel, thereby limiting the usefulness of the vertical slots. Specifically, since the "off-module" partition panels are located between the vertical side edges of a main partition panel, they interfere with attachment of partition mounted furniture components that must be attached to slots of two spaced apart vertical side edges.

Some partition constructions utilize adapter brackets to attach furniture components to partition panels over cover panels at desired locations in workspaces, such as hang-on brackets that engage a top of a partition frame. But adapter brackets are add-on fixes that require additional aesthetically coated parts and pieces. Further, adapter brackets are often cumbersome to install, and have a poor "add-on" appearance. Still further, attachment screws can damage the cover panels locally, preventing the cover panels from being used without the adapter brackets at a later date. Known component attachment constructions are separate from cover panel attachment constructions, and are not integrated to provide a compact design.

Other partition constructions use rails for off-module mounting of partition panels and furniture components. However, rails often have a poor cluttered appearance since they do not blend well with the decor of many partition systems. Further, rails leave an unattractive hole/concavity in a side of the partition panel, even if integrated into the partition frame. Rails attached to an exterior of a partition frame protrude from the partition panel such that they undesirably take up valuable space within a customized workspace. Still further, rails attached "on-module" to partition panels must span completely across a partition panel in order to tie into the vertical slots at each of the vertical side edges of the partition panel, which is not possible when an "off-module" partition panel is in the way.

Another more subtle problem with rail systems results from the fact that rails do not define discrete attachment locations, but instead merely define a continuous track that can be engaged in an infinite number of locations. This is detrimental where there is a need to have accurate "off-module" positioning of a furniture component, without undue effort or measurement by an installer. Notably, many installers, particularly lower skilled installers, are not inclined to take the time necessary to accurately locate the furniture components or off-module partition panels, at least not with the precision optimally desired. This results in random dimensional variations, which are difficult to control and can lead to build problems due to mismatch with other components of the system. Further, even if accurately located, it is possible for many rail-mounted components and/or partition panels be accidentally shifted laterally by overcoming the frictional clamping bracketry used to locate furniture components or partition panels on rails.

Thus, it is desirable to provide an off-module partition construction that allows attachment of off-module partition panels and furniture components accurately and without careful measurement, and without regard to the location of the vertical side edges of partition panels, but which provides secure positioning and attachment so that the partition panels and furniture units cannot be being easily or accidentally shifted off location.

Attachment of cover panels to "off-module" partition constructions is also problematic because, when the workstations are interconnected at off-module locations, the horizontal location of cover panels do not correspond to the edges of the workstations. When this occurs, the off-module partition constructions mismatch unevenly with cover panels at the off-module locations, creating a poor appearance. Further, the mismatched cover panels may become unacceptably trapped behind an "off-module" partition panel, thus preventing access to the area inside of a partition frame. Still further, it is often desirable to horizontally arrange cover panels at discrete incremental locations to achieve a particular design appearance. However, historically, most cover panels are attachable only in a single "on-module" location on a given partition panel.

Planning is particularly difficult where the vertical side edges of partition panels are not regularly separated. This can occur when a connector post is only used at corners, but not along a continuous run of aligned panels. Disadvantageously, known panel-to-panel connection posts result in "creep", which is used herein to refer to the situation where the vertical side edges of partition panels are not located at regular intervals equal to the width of a partition panel, but instead are offset from the "expected" spacing, such as by the width of the posts. Creep also results when bracketry is used to connect panels in "L", "T", or "X" plan configurations. The result of creep can be a nightmare of forced dimensional adjustments throughout the planned layout. This in turn leads to misordering of parts, and a myriad of on-site adjustments during installation.

Trimming out of partition panels to provide a finished appearance is another problem. It is desirable to provide removable trim so that damaged trim pieces can be replaced, instead of replacing the whole partition panel. Also, it is desirable to allow ready access to the interior of partition panels behind the trim. However, "off-module" connected panels interfere with trim unless the trim is recessed into the partition panel, which is inconsistent with an "architectural look", and also interfere with removal of the trim. Also, the ability to remove trim often results in poorly aligned trim pieces, or trim that is easily knocked out of position. Still further, removable trim may have a cheap "add-on" appearance, even if attached correctly, unless the trim is securely held in a squared/true position relative to the partition panel.

Thus, a partition system including trim therefor is desired solving the aforementioned problems.

SUMMARY OF THE INVENTION

In one aspect of the present invention, a partition construction includes a first partition frame having opposing vertical edges and at least one elongated horizontal frame member extending between the vertical edges, the at least one horizontal frame member defining a row of accessible apertures spaced horizontally apart, the first partition frame further including at least one cover panel partially covering the at least one horizontal frame member but providing horizontal access to said row of apertures. A second partition frame has a vertical side edge positioned proximate the first partition frame in an off-module position between the vertical edges of the first partition frame, the second partition frame including at least another horizontal frame member having an end positioned proximate the at least one horizontal frame member. A U-shaped off-module connector having a pair of legs defines a pair of opposing hooks for engaging a selected one of the apertures and a rear section connecting the legs, the rear section being configured for connection to the vertical side edge of the at least another horizontal frame member of the second partition frame.

In another aspect, a partition construction includes a first partition frame having opposing vertical edges and at least one elongated horizontal frame member extending between the vertical edges, the at least one horizontal frame member defining a row of apertures spaced horizontally apart, the apertures defining a smaller-sized lower section and an enlarged upper section connected to the lower section. A cover panel has a covering part shaped to cover at least a portion of the partition frame, and a pair of connectors attached to the covering part that are configured to engage the smaller-sized lower sections of selected ones of the apertures. The covering part, when the cover panel is attached to the partition frame, is configured to provide access to the enlarged section of the apertures in the row of apertures when attached to the partition frame. A bracket has a front section for engaging a selected one of the enlarged sections of the apertures, the bracket also having a rear section configured to support one of a furniture component and another partition frame.

In another aspect, a partition construction includes a first partition frame having opposing vertical side edges and at least an upper and a lower horizontal frame member extending between the vertical side edges. Each of the upper and lower frame members define a row of apertures spaced horizontally apart, with some of the apertures in the upper row being formed as part of a configured aperture defining a smaller-sized lower section and an enlarged upper section connected to the lower section. A cover panel includes a covering part shaped to cover at least a portion of the partition frame. The cover panel includes a pair of upper connectors configured to engage the smaller-sized lower section of selected ones of the configured apertures while providing access to the enlarged section of the configured apertures in the row of apertures, and further includes a lower connector for retaining a bottom portion of the cover panel to the lower frame member. Thus, the enlarged section of the configured apertures in the upper frame member is accessible and engageable by a bracket for supporting a furniture component even when the cover panel is attached to the partition frame.

In yet another aspect, a partition frame includes a pair of tubular uprights spaced apart each having opposing spaced apart faces and also top and bottom ends. The partition frame further includes at least one pair of hat-shaped channels positioned on opposite sides of the tubular uprights and at a common height, the hat-shaped channels extending horizontally and including a pair of notches for receiving half of the tubular uprights, the hat-shaped channels including a center flange and a pair of wing flanges that are parallel but non-coplanar with the center flange. The center flange of the hat-shaped channels abut the tubular uprights at the notches and the wing flanges are cut away at the notches to provide a tight assembly. The wing flanges of the hat-shaped flanges are secured together and the center flange is secured to the tubular uprights to form a rigid construction.

In still another aspect, a partition system includes frame members defining a horizontal row of apertures, and a removable cover panel with at least three horizontally-spaced attachment locators/connectors shaped to engage selected ones of the apertures. The attachment locators/connectors include a first connector shaped to accurately set the horizontal and vertical position of a first corner of the cover panel, a second connector shaped to accurately set the vertical position of a second corner of the cover panel but not the horizontal position thereof, and at least one intermediate third connector shaped to hold the cover panel to the frame but which does not set either the horizontal or vertical position of the cover panel.

In another aspect, a partition system includes a frame having a pair of closely spaced apertures, and a cover panel having a locator/connector for engaging one of the pair of apertures and an integral locking tab spaced therefrom for engaging the other pair of apertures, respectively. The cover panel further includes a body for covering the frame when the cover panel is attached to the frame.

These and other features and advantages of the present invention will be further understood and appreciated by those skilled in the art by reference to the following specification, claims, and appended drawings.

DESCRIPTION OF DRAWINGS

FIGS. 7 and 8 are fragmentary enlarged views of the circled areas labeled VII and VIII, respectively, in FIG. 5;

FIG. 9 is an exploded perspective view of the partition frame shown in FIG. 2;

FIG. 10 is an enlarged fragmentary perspective view of an end of the top frame support shown in FIG. 2;

FIG. 40 is a side view of the permanent metal push-pin rivet shown in FIG. 39;

FIG. 42 is a perspective view of a slat wall construction;

FIG. 43 is a fragmentary cross-sectional side-elevational view of an attachment construction for a permanently attached hinged slat wall;

FIGS. 44 and 45 are fragmentary cross-sectional views of a modified, permanently attached, hinged slat wall;

FIG. 79 is a bottom view of the end cap shown in FIG. 78;

FIG. 80 is a cross sectional view taken along the line LXXX—LXXX in FIG. 79;

FIG. 81 is a bottom view of the top cap shown in FIG. 78;

FIG. 82 is a cross sectional view taken along the line LXXXII—LXXXII in FIG. 81;

FIGS. 83 and 84 are front and bottom views of the rectangular corner piece shown in FIG. 78;

FIG. 85 is a cross sectional view taken along the line LXXXV—LXXXV in FIG. 83;

FIG. 86 is an enlarged fragmentary view of the circled area labelled LXXXVI in FIG. 83;

FIGS. 87 and 88 are end and plan views of the spline shown in FIG. 78;

DETAILED DESCRIPTION OF PREFERRED EMBODIMENT

Figure 5:
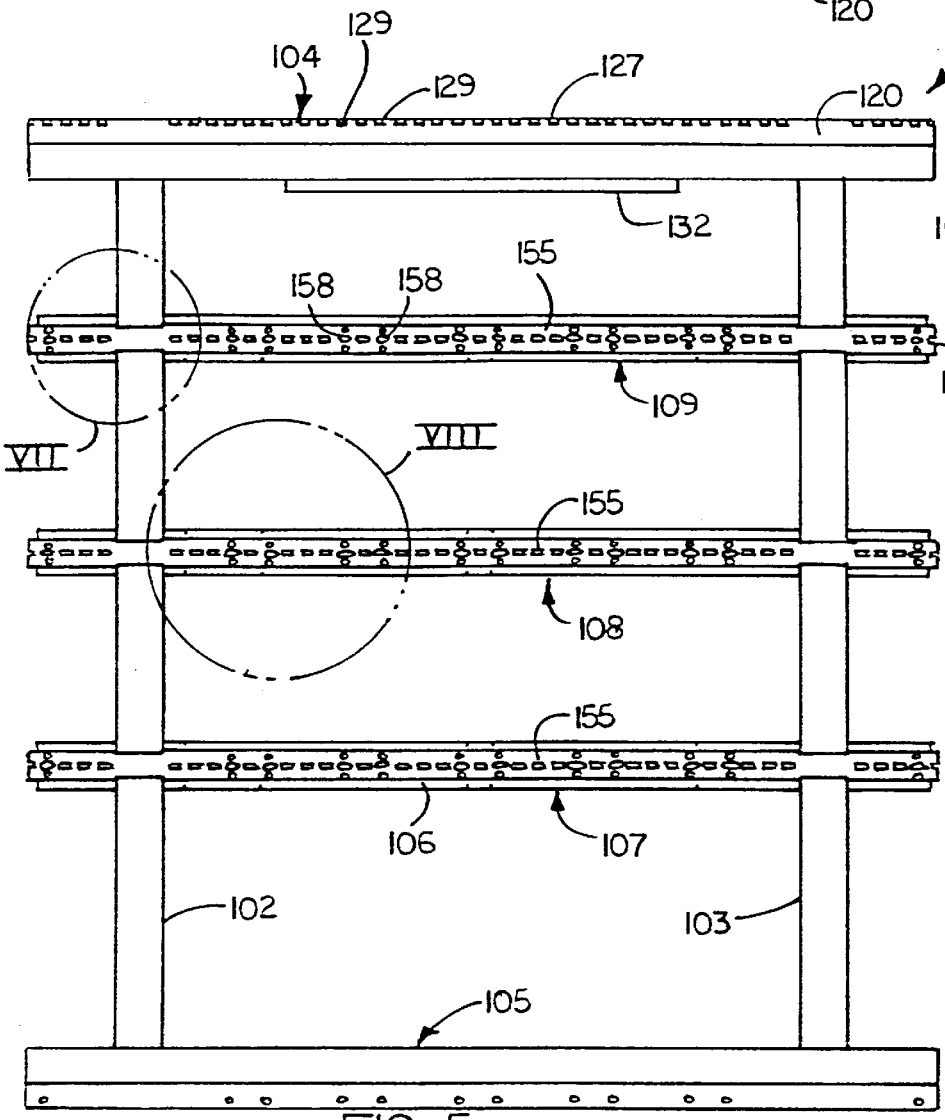
Figure 6:
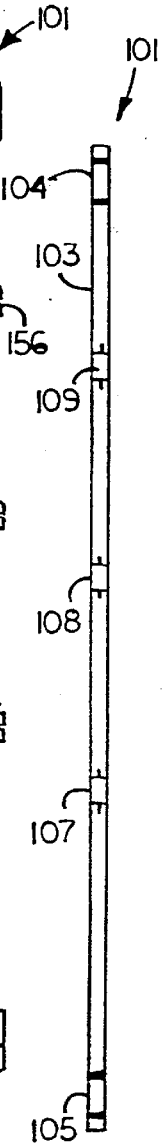

For purposes of description herein, the terms "upper", "lower", "right", "left", "rear", "front", "vertical", "horizontal", and derivatives thereof shall relate to the invention as oriented in FIG. 5, the front of the partition frame facing out from the printed page. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A furniture system 80 (FIG. 1) includes a plurality of interconnectable systems for outfitting an entire building space, including a four-inch thick "Zone wall" partition system 81, a "Plus wall" architectural wall covering system 82, a storage wall system 83, and other systems such as a "Link wall" hallway partition system, expressway system, a transom system, and a column covering system. The furniture system 80 further includes a two-inch Zone wall or FIN wall partition system 100 having the advantage of lower cost and reduced footprint over the larger four-inch Zone wall partition system 81. Advantageously, the FIN wall 100 incorporates many of the features of the four-inch Zone wall system 81, including a partition frame having an open interior with hang-on cover panels. The partition frame includes horizontal frame members that facilitate off-module attachment of other partition frames and furniture components to a selected partition frame. Also, the FIN partition construction 100 is relatively easily detachable and reattachable in an off-module location on the partition system 81 and/or to itself, thus facilitating rearrangement for meeting changing office needs.

Figure 2:
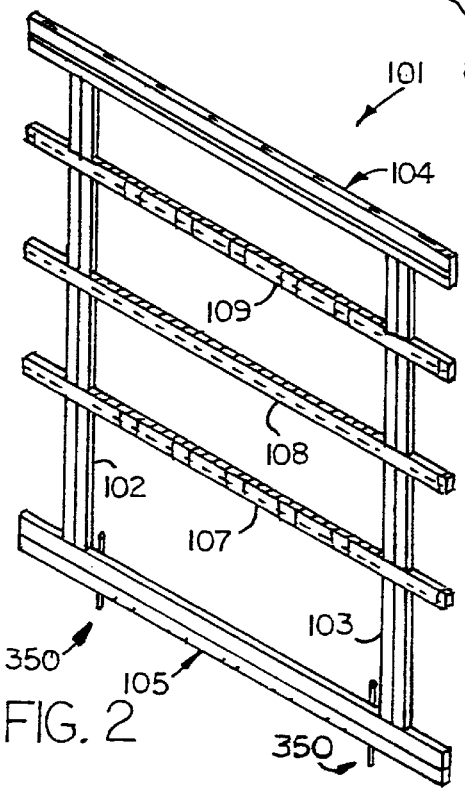
FIG. 2 is a perspective view of a partition frame embodying the present invention.
Figure 3:
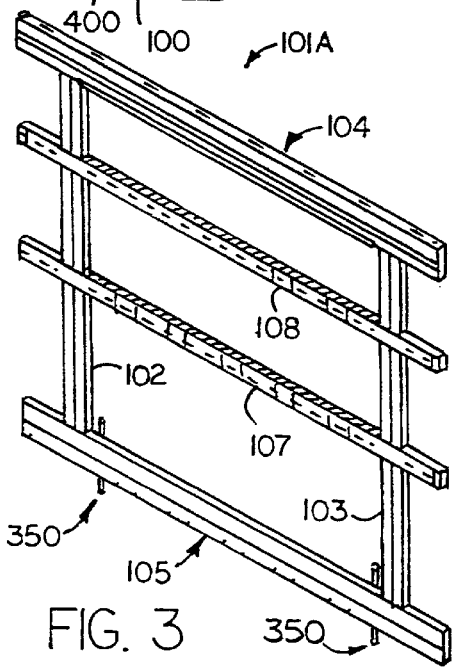
FIG. 3 is a perspective view of another partition frame embodying the present invention.
Figure 4:
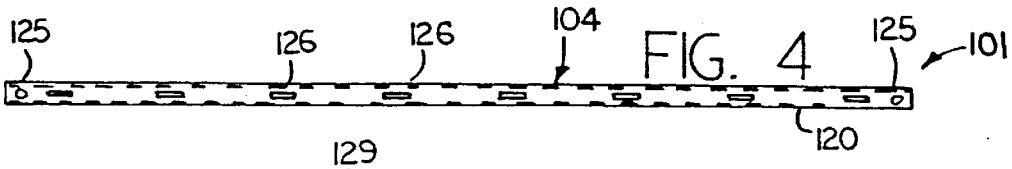
FIGS. 4–6 are top, front, and side views of the partition frame shown in FIG. 2.
Figure 21:
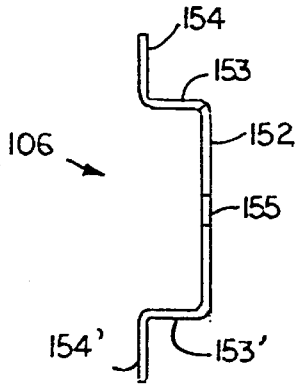
FIGS. 19–21 are top, side, and end views of one of the hat-shaped channels forming the intermediate horizontal frame members shown in FIG. 9.
Figure 19:
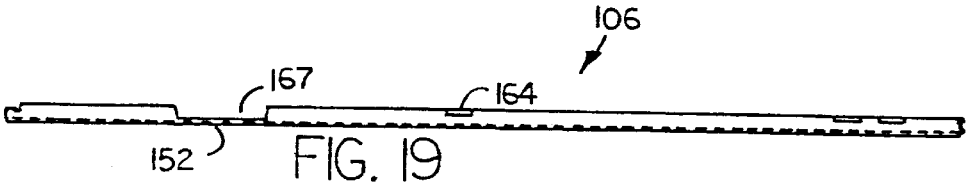
Figure 20:
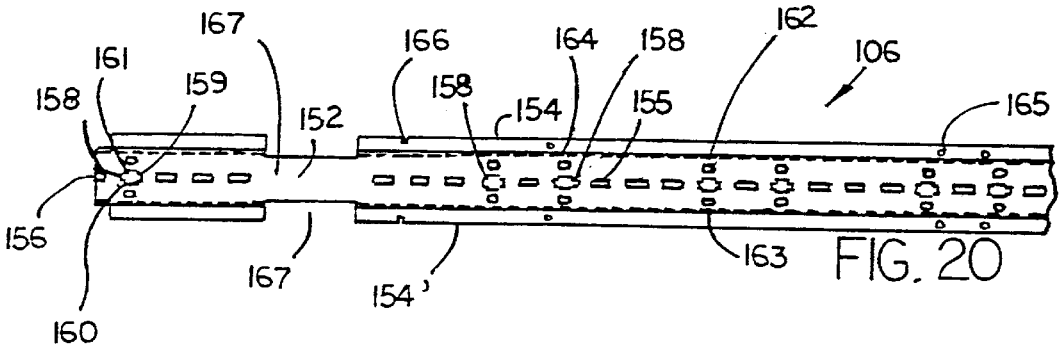
Figure 64:
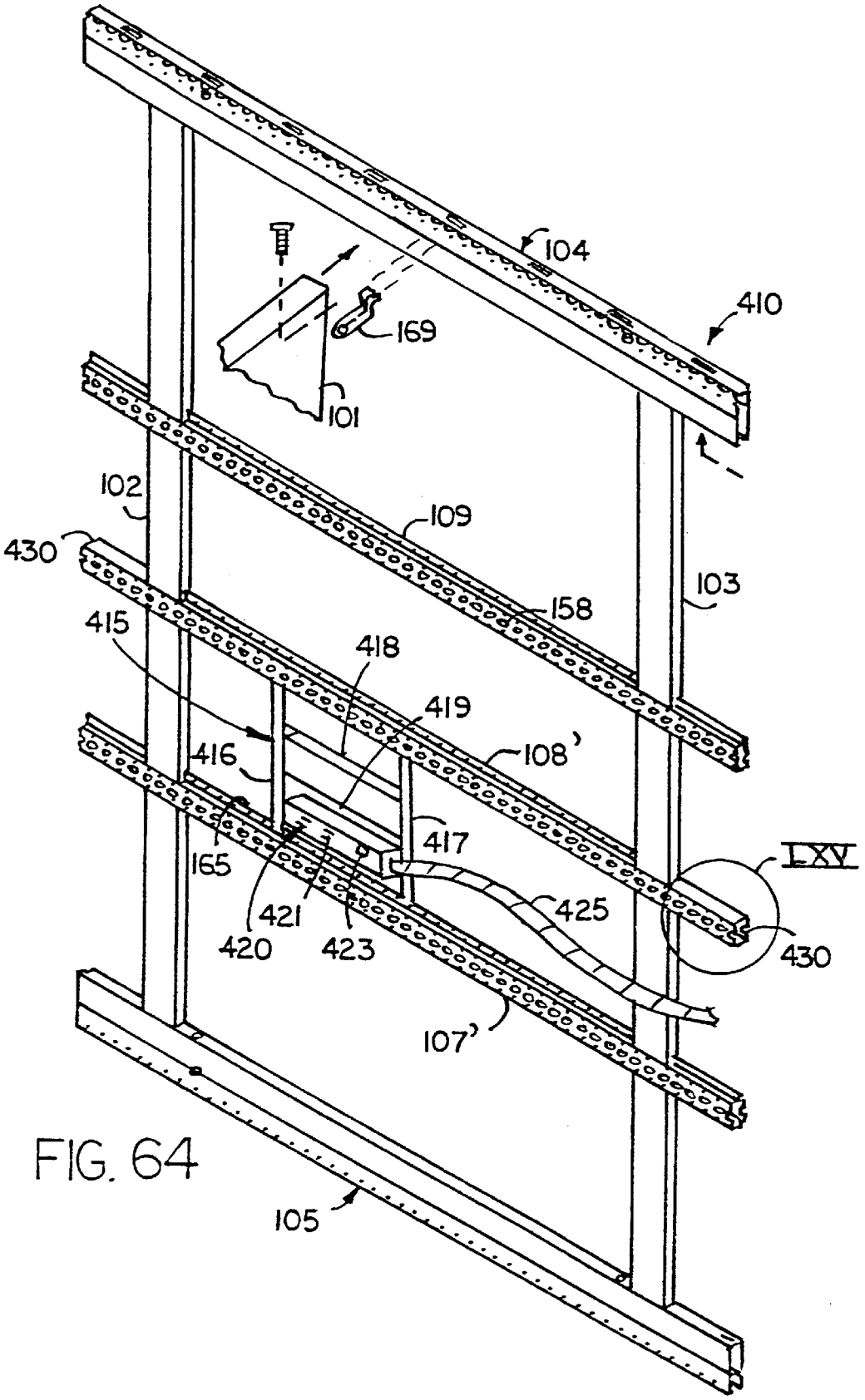
FIG. 64 is a perspective view of a modified partition frame not unlike the partition frame of FIG. 2, but modified to include additional apertures and to include a modified end section on the middle intermediate horizontal frame member.

The FIN partition construction 100 can be manufactured in a variety of different heights and lengths, as illustrated by comparing FIN partition frame 101 (FIGS. 2 and 5) with FIN partition frame 101A (FIG. 3) and with FIN partition frame 410 (FIG. 64). FIN partition frame 101 (FIG. 5) includes at least a pair of vertically extending tubular frame supports or uprights 102 and 103, connected at their ends by top and bottom horizontal frame supports 104 and 105. A plurality of roll-formed hat-shaped channel members 106 (FIGS. 19–21) are welded to opposing sides of uprights 102 and 103 at various desired locations to form intermediate horizontal frame members. For example, frame 101 (FIG. 2) and frame 101A (FIG. 3) include first and second intermediate horizontal frame members 107 and 108 formed from opposing pairs of channel members 106 located at a worksurface height and just above a worksurface height, respectively, while frame 101 (FIG. 2) further includes an additional horizontal frame member 109 (FIG. 2) at a location several inches above worksurface height. It is contemplated that the top of FIN partition frame 101 can be constructed to be at an eye-level height when sitting or standing, or at any height above or below the same. Further, where the FIN partition wall is elongated horizontally, additional uprights can be added.

Uprights 102 and 103 (FIG. 9) have a rectangular cross section, the longer cross-sectional dimension extending horizontally parallel the plane of the FIN wall frame 101. Top and bottom supports 104 and 105 include horizontally disposed rectangular tubes 110 and 111, respectively, of identical cross sectional shape to uprights 102 and 103. Uprights 102 and 103 are butt welded to top and bottom rectangular tubes 110 and 111 at locations spaced several inches from the ends of horizontal tubes 110 and 111 to form a rigid rectangular framework subassembly.

Figure 12:
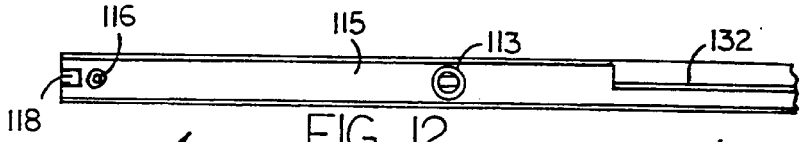
Figure 13:
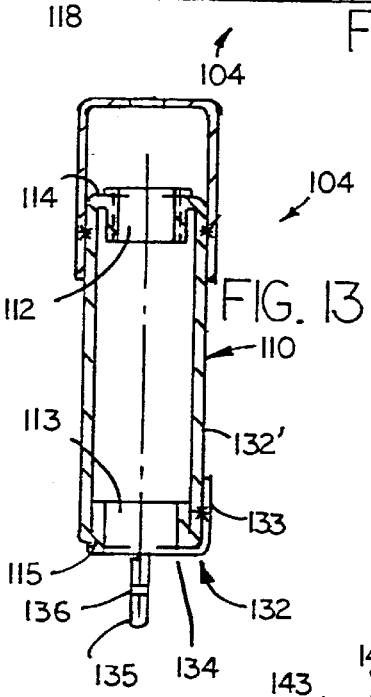
FIG. 13 is a cross-sectional view taken along the line XIII—XIII in FIG. 11.

The illustrated rectangular tube 110 of top frame support 104 (FIGS. 12 and 13) includes extruded holes 112 and 113 in its top and bottom walls 114 and 115, respectively. It is noted that extruded holes 112 and 113 can be eliminated where they will not be used. When present, extruded holes 112 and 113 align vertically with each other, and are formed inwardly of the ends of rectangular tube 110 so that the holes 112 and 113 are located offset and inboard from uprights 102 and 103. Holes 112 and 113 can be used for receiving a bayonet-type connector (not shown) on a stackable partition frame that is stacked on top of partition frame 101. Tube 110 further includes other extruded holes 116 in its top and bottom walls 114 and 115 located proximate each end of tube 110. Extruded holes 116, tapped if desired, are configured to receive a screw (not specifically shown) for connecting an in-line connector (see FIG. 27) or an off-module connector (see FIGS. 27 and 29) to the frame 101. The ends of tube 110 each include notches 117 and 118 in top and bottom walls 114 and 115. The notch 117 in top wall 114 includes barbs 119 (FIG. 10), such as for retaining a trim piece or trim piece retainer to the end of tube 110. The sides of tube 110 can include screw holes to facilitate attachment of brackets to the sides of tube 110 if desired.

Top frame support 104 (FIG. 10) includes an inverted U-shaped channel 120 welded to tube 110. U-shaped channel 120 includes a transverse wall 121 spaced above tube 110 and side walls 122 and 123 that straddle and overlap onto the sides of tube 110, such that the transverse wall 121 creates a space 124 inside of channel 120 above tube 110. Access holes 125 are formed in transverse wall 121 for providing access to extruded holes 116. A plurality of regularly spaced apart slots 126 are formed in transverse wall 121 for receiving attachment barbs of a top trim piece. Two of slots 126 also provide access to extruded holes 112.

Figure 11:
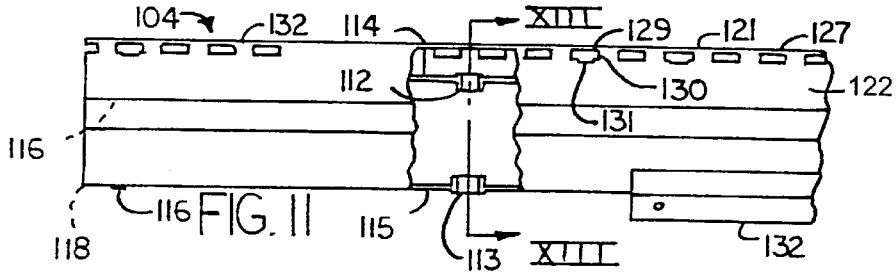
FIGS. 11 and 12 are side and bottom views of the top frame member shown in FIG. 5.

A horizontal row of regularly spaced slots 127 (FIG. 11) are formed along the corner of transverse wall 121 and side wall 122, and a corresponding row of slots 128 (FIG. 10) are formed along the corner of transverse wall 121 and side wall 123. These slots 127 and 128 are configured to horizontally laterally receive hooked brackets, such as for mounting furniture components or off-module positioned partition frames to frame 101. Slots 127 and 128 can be located at any desired unitary spacing, but are optimally located at about a one-inch spacing or a similar metric spacing so that a plurality of point-specific attachment locations are formed. The slots 127 and 128 are also spaced so that sufficient structure remains for attachment bracketry, as discussed below. Several of slots 127 and 128 are formed as part of a configured slot 129 (FIG. 11). The configured slots 129 are T-shaped when viewed from a side, and include an enlarged upper section 130 replicating the slots 127 and 128, and further include a smaller lower section 131. Smaller lower section 131 is shaped to receive a locator/connector on cover panels, as discussed below. Pairs of configured slots 129 are located so that the cover panels can be attached to frames 101 abuttingly adjacent each other for covering frames 101. The location of the pairs of configured slots 129 allow the cover panels 210 to be selectively located on the frames 101 about every six inches. Other regular locations of configured slots 129 are also contemplated, such as that would provide cover panel attachment locations every 12 inches, or every 20 centimeters, or at any regular English based or metric based unit of distance. This allows the cover panels 210 to be shifted horizontally to various discrete positions to facilitate reconfiguration of offices.

Figure 14:
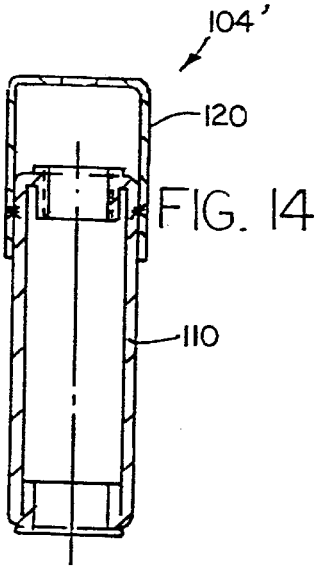
FIG. 14 is a cross-sectional view of a modified top frame member.

A Z-shaped bracket 132 (FIG. 13) is welded to a bottom and side of tube 110 to provide additional attachment locations for utility-supporting bracketry under top support 104. Bracket 132 provides additional strength to tube 110, and also provides a flush outer surface at the top and bottom of tube 110 on the side 132' of tube 110 to which the Z-shaped bracket 132 is welded. Z-shaped bracket 132 includes a first leg 133 welded to a side of tube 110, a laterally extending second leg 134 (welded to a bottom of tube 110 if desired) extending from first leg 133, and a depending third leg 135 extending downwardly from middle section 134. Third leg 135 includes holes 136 for receiving fasteners to secure brackets and components to top support 104, such as electrical and telecommunication hardware. Notably, third leg 135 is doubled back such that it includes a double thickness of sheet material for increased strength and so that its side surfaces are vertically aligned with flanges 154 and 154' of hat-shaped channel 106, discussed hereafter. The attachment of the Z-shaped bracket 132 to tube 110 is optional, as shown by top frame support 104' (FIG. 14) where bracket 132 is eliminated.

Figure 15:
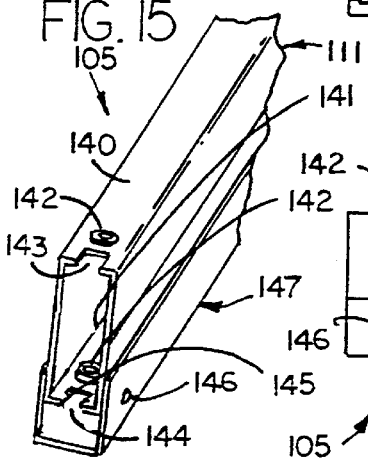
FIG. 15 is a fragmentary perspective view of the bottom frame member shown in FIG. 2.
Figure 16:
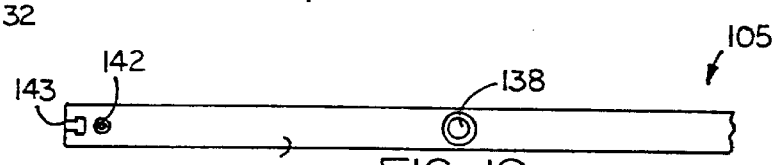
FIGS. 16 and 17 are top and side views of the bottom frame member shown in FIG. 2.
Figure 17:
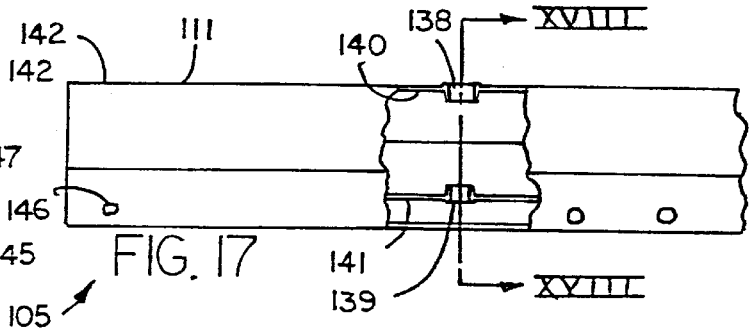
Figure 18:
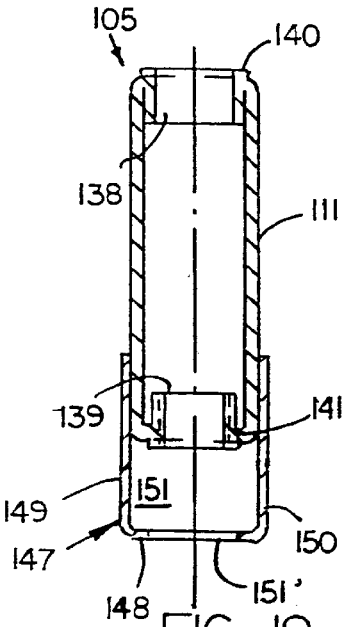
FIG. 18 is a cross sectional view taken along the line XVIII—XVIII in FIG. 17.

Bottom horizontal frame support 105 (FIGS. 15–18) is generally similar to top horizontal frame support 104, but is inverted on frame 101. The rectangular tube 111 of bottom frame support 105 (FIG. 18) includes extruded holes 138 and 139 in its top and bottom walls 140 and 141, respectively. Extruded holes 138 and 139 vertically align with each other, and are formed inwardly of the ends of rectangular tube 111 so that the holes 138 and 139 are located offset from uprights 102 and 103 and are located generally below holes 112 and 113. Holes 138 and 139 are threaded and configured to receive a leveler screw, as discussed below. Hole 139 is threaded for receiving leveler screw 391, and hole 138 is enlarged and acts as a bearing/guide for the leveler screw 391. Tube 111 (FIG. 15) further includes other extruded holes 142 in its top and bottom walls 140 and 141 located proximate each end of tube 111. Extruded holes 142 are configured to receive a screw (not specifically shown, self tapping or configured to engage pre-tapped holes) for connecting an in-line connector to the frame 101. The ends of tube 111 each include notches 143 and 144 in top and bottom walls 140 and 141. The notch 144 in bottom wall 140 includes barbs 145, such as for retaining a trim piece or trim piece retainer to the end of tube 110. The sides of U-shaped channel 147 include holes 146 for receiving fasteners to facilitate attachment of brackets to the sides.

Bottom frame support 105 (FIG. 18) includes an upwardly facing U-shaped channel 147 welded to tube 111. U-shaped channel 147 includes a transverse wall 148 spaced below tube 111 and side walls 149 and 150 that straddle and overlap onto the sides of tube 111, such that the transverse wall 148 creates a space 151 inside of channel 147 below tube 111. A hole 151' is formed in bottom wall 148 below threaded leveler-receiving holes 138 and 139. Other features of top frame support 104 can be added to bottom frame support 105 if desired. It is contemplated that the top and bottom frame supports 104 and 105 could be made identical if desired.

Hat-shaped channels 106 (FIGS. 19–21) each include a center flange 152, perpendicular side flanges 153 and 153', and opposing wing flanges 154 and 154'. Center flange 152 includes a centered row of regularly spaced apart slots 155. The row of slots 155 extend longitudinally the length of channel 106, and are interrupted only at the locations where tubular uprights 102 and 103 are attached. It is noted that on the four-inch Zone wall partition frame 81', the row of horizontal slots extrude horizontally without interruption. (See FIG. 29) Also, the slots 155 can be continued across the area of the uprights. (See FIG. 64) In the illustrated embodiment, a "half" slot 156 is formed at each end of the channels 106, so that when partition frames 101 are interconnected in-line, the regularly spaced pattern of slots continues uninterrupted in a regular pattern across the joinder of adjacent partition frames 101. The slots 155 are configured to receive hooked brackets, such as for mounting furniture components or off-module positioned partition frames to frame 101.

Figure 32:
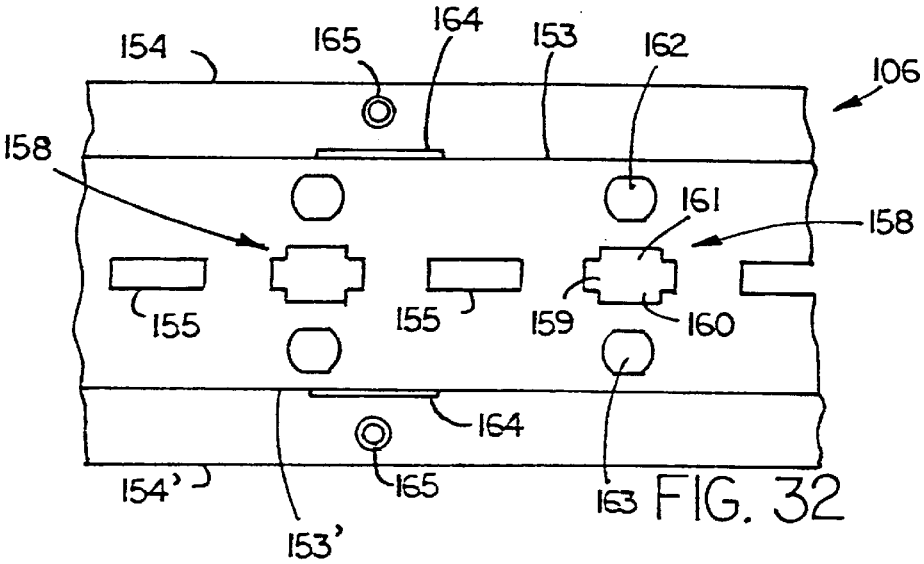
FIG. 32 is a enlarged fragmentary side view of a section of the horizontal frame member shown in FIG. 8.

Some of slots 155 are formed as part of a configured aperture 158. The configured aperture 158 (FIG. 32) is plus shaped ("+" shaped), and includes an enlarged middle section 159 replicating a slot 156, and further includes smaller lower and upper sections 160 and 161, respectively. The lower section 160 is configured to be engaged by a locator connector 216 on the cover panels 210, as described below. The upper smaller section 161 is formed in configured aperture 158 mainly so that the configured aperture 158 and the channel 106 is symmetrical, thus helping prevent misassembly of channel 106 to frame 101. However, upper smaller section 161 can also be engaged by a connector if desired, as described below. Slots 156 correspond to and are located vertically aligned with slots 127 (and 128) (FIG. 5) on top frame support 104, and configured apertures 158 correspond to configured apertures 129 on top frame support 104, when channels 106 are attached to uprights 102 and 103.

Lower and upper holes 162 and 163 (FIG. 32) are formed above and below the plus-shaped apertures 158. Lower holes 162 are designed for engagement by a screw or other bracket connector, or by anti-dislodgement tabs 224 on the locator connectors 216 on the cover panels 210, described below. (See FIG. 34) Additional slots 164 and holes 165 (FIG. 32) are formed in side flanges 153 and 153' and wing flanges 154 and 154', respectively, as desired such as for receiving fasteners and/or tabs for attaching brackets and/or components to frame 101. Holes 165 can be regularly spaced or formed only at predetermined locations. Small notches 166 (FIG. 20) are formed along an outer edge of wing flanges 154 for keys for fixturing and/or for alignment purposes when assembling opposing channels 106 together to form the intermediate frame members 107 (and 108 and 109). Notches 166 can also be used as locators or attachment structures for receiving legs on components attached to channels 106. Large notches 167 are cutout of side flange 153 and wing flange 154, and also are cutout of side flange 153' and wing flange 154'. Notches 167 are sized and located to mateably receive uprights 102 or 103, such that the center flange 152 can be positioned against uprights 102 and 103 and welded thereto.

Assembly of partition frame 101 can be accomplished in a variety of different sequences. In one method, tubular uprights 102 and 103 are positioned between top and bottom tubes 110 and 111, and are butt welded thereto. Intermediate channels 106 are then welded to the subassembly of tubes 102, 103, 110, and 111 and are also welded to each other. Thereafter, top and bottom U channels 120 and 147 are welded to top and bottom tubes 110 and 111, respectively.

Figures 22, 23, 24, 25, 26, 28:
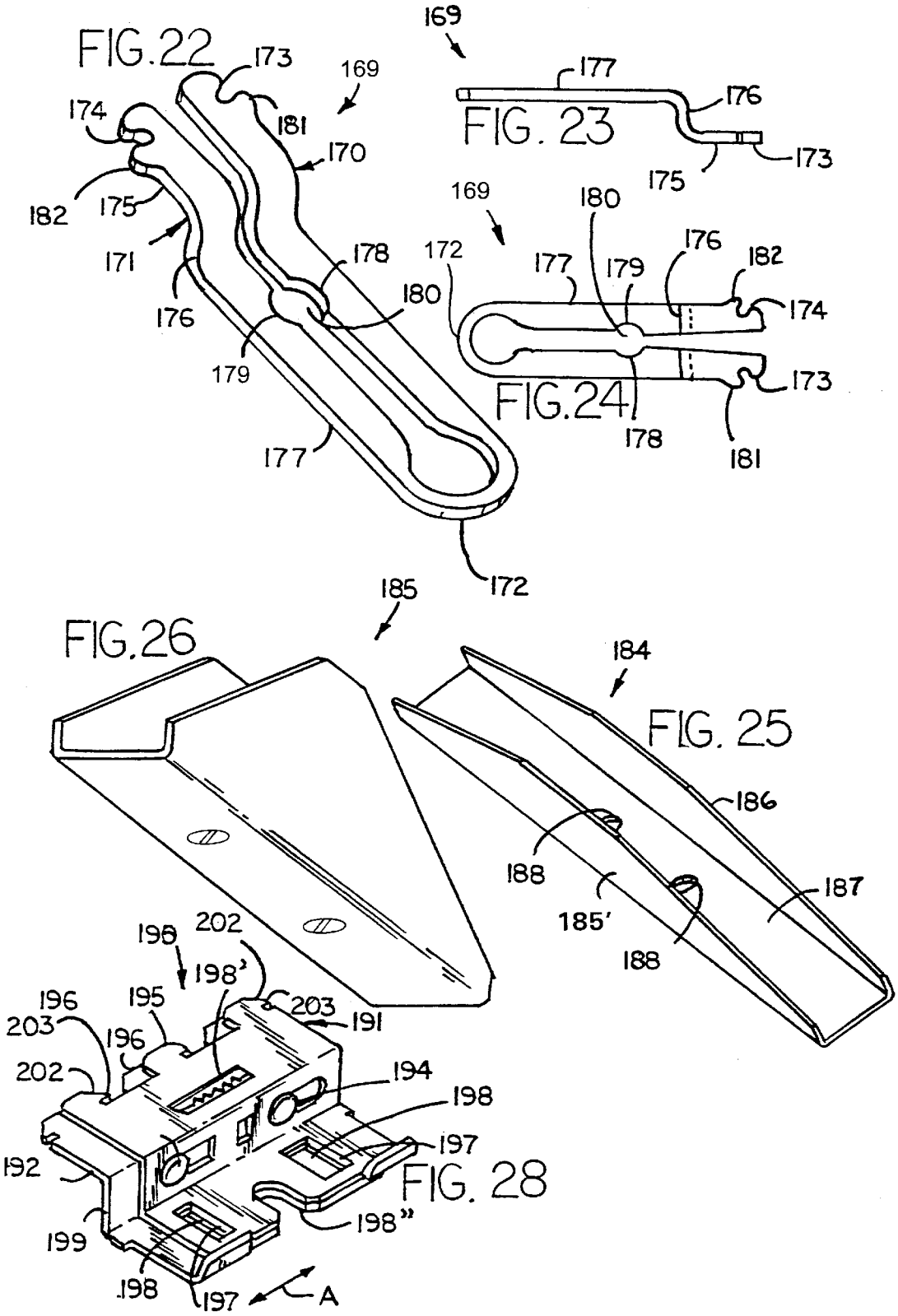
FIG. 22 is a perspective view of an off-module attachment bracket.
FIGS. 23 and 24 are side and plan views of the off-module attachment bracket shown in FIG. 22.
FIGS. 25 and 26 are perspective views of two different in-line connector brackets.
FIG. 28 is a perspective view of another off-module connector bracket.
Figure 29:
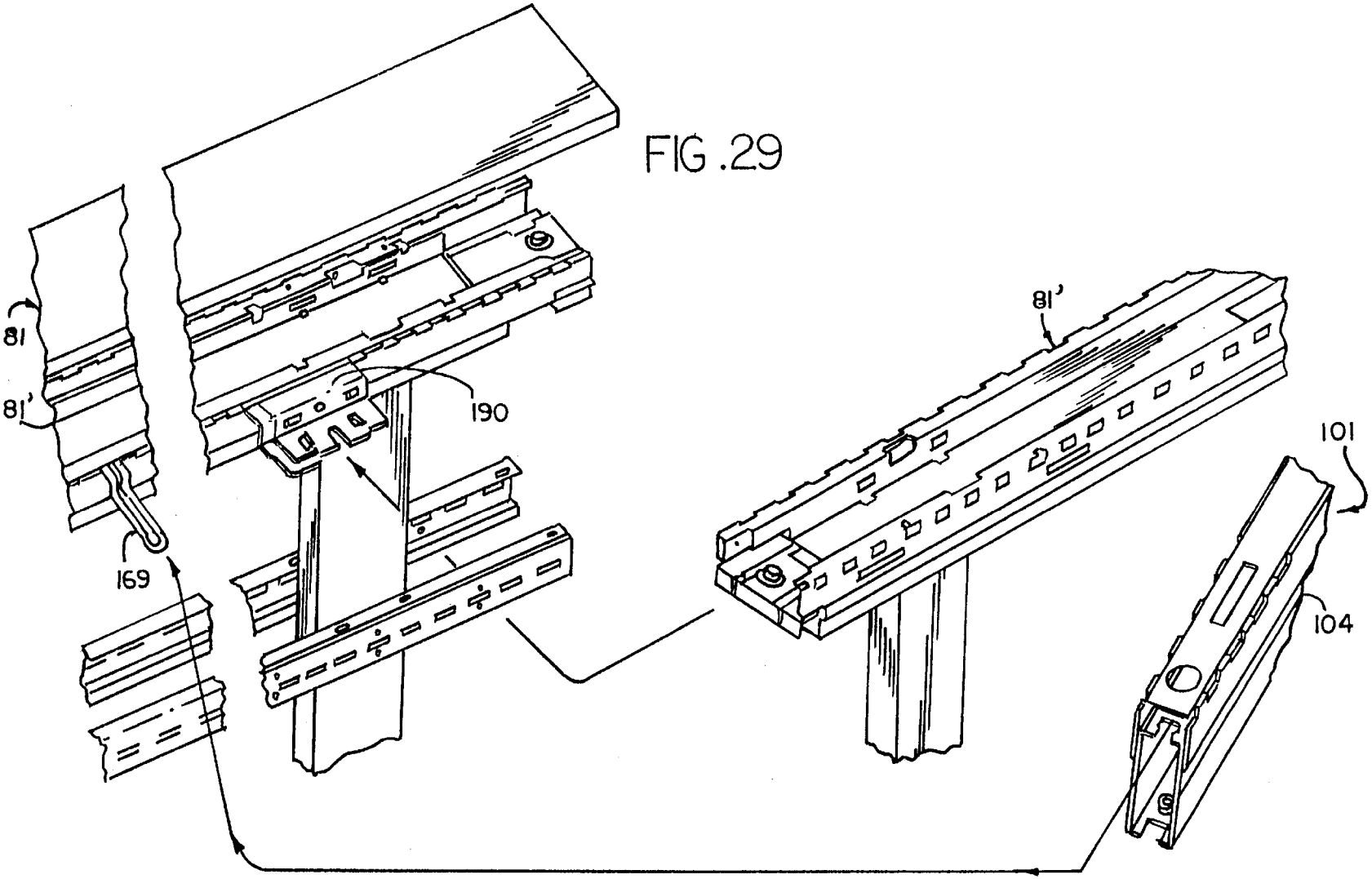
FIG. 29 is an exploded fragmentary perspective view of a two-inch partition frame and a four-inch partition frame connected off-module to a second four-inch partition frame utilizing the off-module brackets of FIG. 22 and FIG. 28, respectively.
Figure 31:
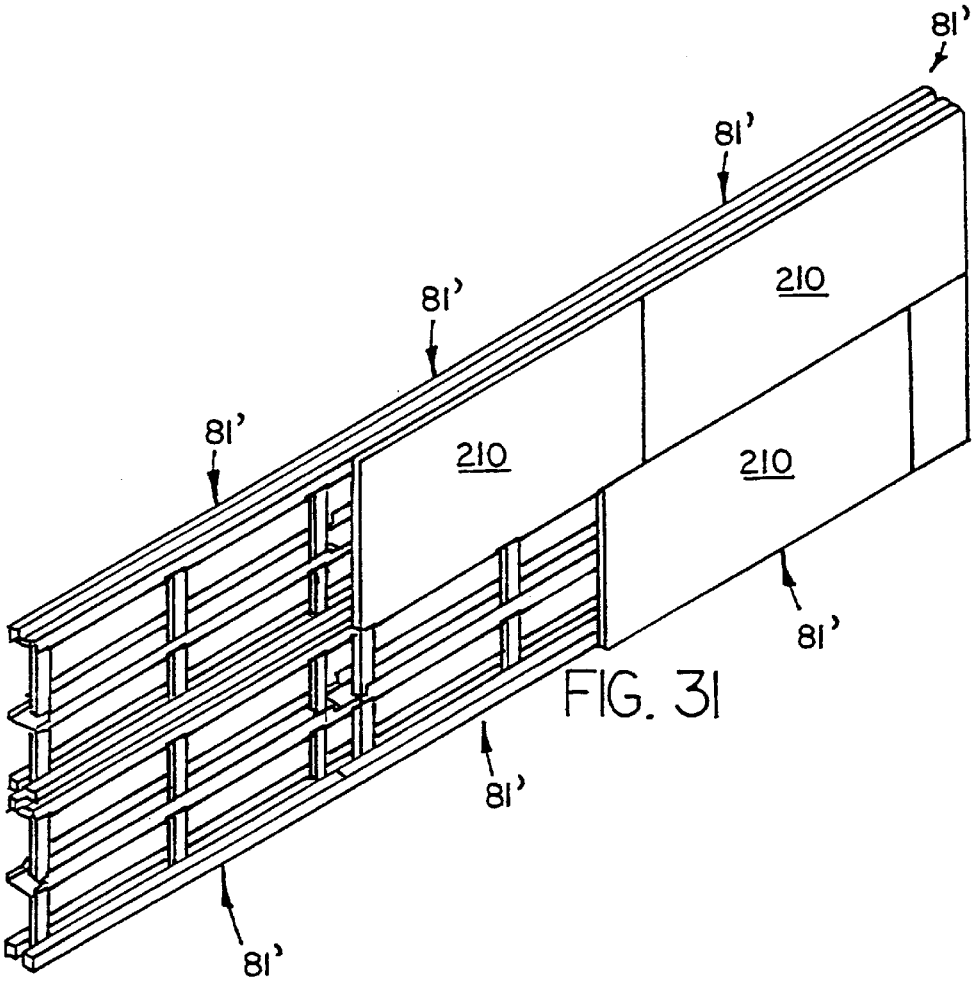
FIG. 31 is a perspective view of a wall constructed from partition frames and partially covered with horizontally repositionable/adjustable cover panels.

An off-module connector or bracket 169 (FIGS. 22–24) is provided for interconnecting a FIN wall partition frame 101 to another FIN wall partition frame 101, or more commonly to a four-inch Zone wall partition frame (see FIG. 29). Off-module connector 169 (FIG. 22) is stamped from sheet metal and includes a pair of legs 170 and 171 interconnected by a resilient rear section 172. Legs 170 and 171 are mirror images of each other, and include opposing outwardly facing hooked ends 173 and 174. Legs 170 and 171 are spaced apart so that they can be flexed toward each other to allow them to slide into a selected slot, such as frame slots 127 (or 128) (FIG. 5) or 155, or into the center of configured slots 129 or 158, or into a slot comprising abutting half slots such as slots 156 on two in-line connected partition frames 101. Legs 170 and 171 (FIG. 23) are elongated and Z-shaped, and each include a first section 175 that extends from hooked end 173 (or 174), a perpendicular second section 176, and a third section 177 that extends parallel first section 175 but that is non-coplanar therewith. The first section 175 spaces the second section 176 a predetermined distance away from partition frame 101 so that second section 176 is located just outside of and adjacent the exterior surface of a cover panel 210 attached to partition frame 101 or 81 (FIG. 29). The third section 177 is positioned to telescope into an end of an off-module positioned partition frame 101 (compare FIGS. 27 and 29). Specifically, at the top, the rear end section 177 of the off-module connector 169 is positioned to extend onto the top of top tube 110 within U-channel 120 (FIG. 29). The legs 170 and 171 of bracket 169 (FIG. 22) include opposing arcuate recesses 178 and 179 forming a space 180 for receiving a screw extended into extruded hole 116 in tube 110 (FIG. 22). When the screw is threaded into extruded hole 116, the shaft of the screw occupies space 180, preventing the legs 170 and 171 from being compressed together. This prevents the legs 170 and 171 from disengaging from the slot on the frame 101 to which they are attached. Notably, the hooked ends 173 and 174 also include stop tabs 181 and 182 that prevent the bracket 169 from being extended "too far" into the selected slot in frame 101. The combination of recesses 178 and 179 with stop tabs 181 and 182 provide a positive assembly sequence that helps assure proper assembly. It is noted that the off-module bracket 169 is inverted up-side-down when engaged with a floor channel for attaching a lower part of an off-module partition panel to another partition panel.

In-line connectors 184 and 185 (FIGS. 25 and 26) are provided for interconnecting partition frames 101 in an in-line adjacent arrangement. The in-line connectors 184 and 185 are substantially identical except the side flanges on connector 185 are enlarged to provide greater stiffness. Since the connectors are substantially identical, only connector 184 will be described below. The in-line connector 184 is U-shaped, and includes triangularly shaped side walls 185' and 186 interconnected by a crossover flange 187. The crossover flange 187 includes a pair of holes 188 located proximate but spaced longitudinally from the middle of connector 184. Side walls 185' and 186 are spaced apart to closely receive an end of top tube 110 (FIG. 27), or to closely receive an end of the bottom tube 111. When used at the top, the in-line connector 184 faces upwardly. When used at the bottom, the in-line connector 184 faces downwardly. (See FIG. 27) One of the holes 188 aligns with the extruded hole 116 in each of the top tubes 110 on adjacently positioned partition frames 101, such that when screws are threaded into the respective extruded holes to clampingly retain the in-line connector 184 to the respective frames 101, the frames are secured tightly together. The in-line connector 184 closely engages the sides of tubes on adjacent frames 101, thus assuring alignment of adjacent in-line frames 101. Notably, the shape, size, and thickness of side walls 185' and 186 can vary as long as sufficient torsional and structural strength is maintained for the particular application where the connector 184 will be used.

Figure 27:
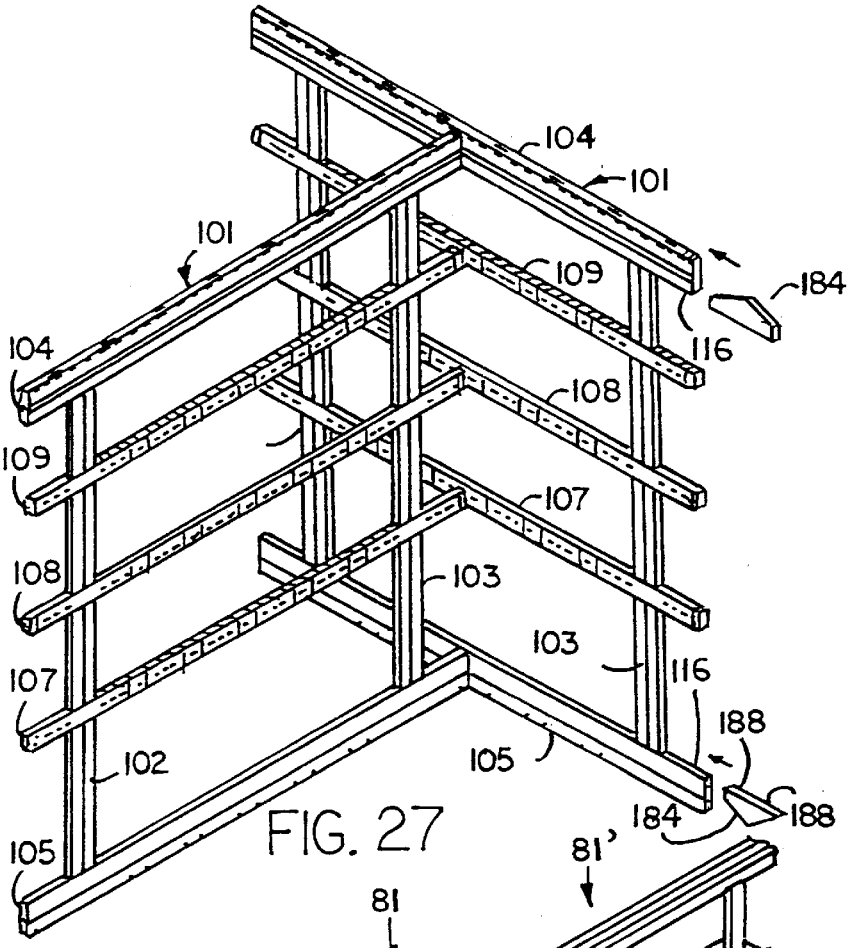
FIG. 27 is a perspective view of two partition frames connected in an off-module T-shaped arrangement.
Figure 30:
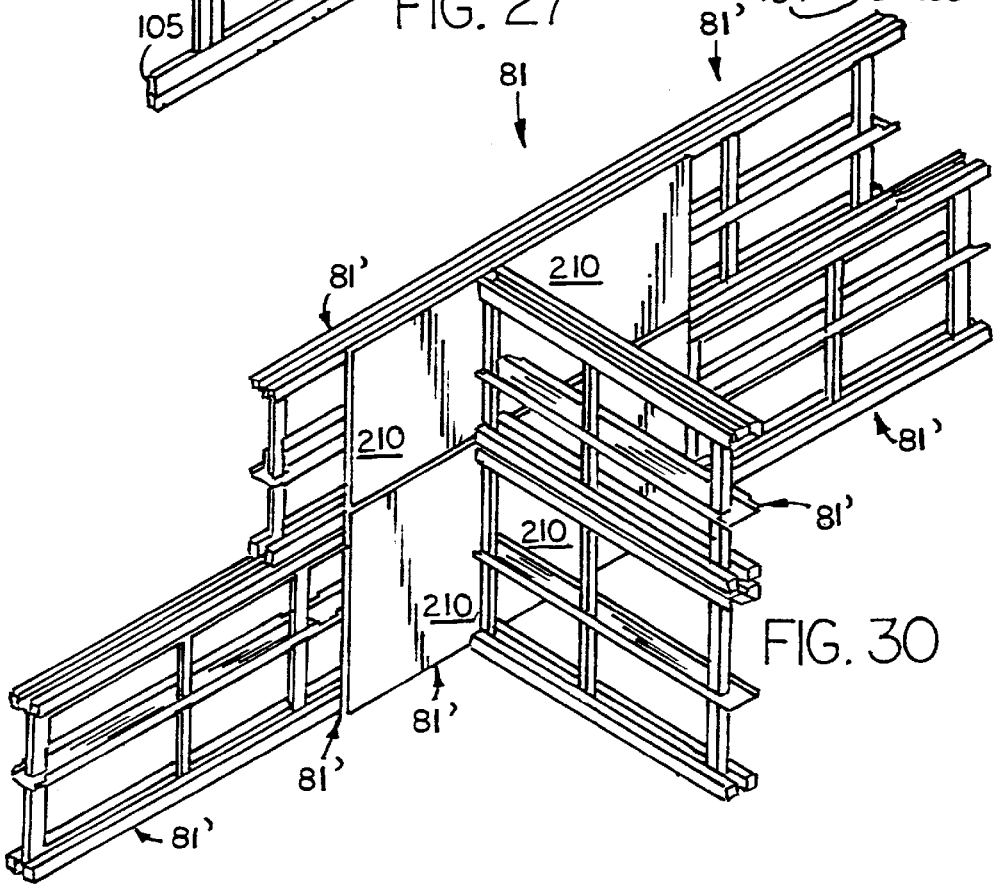
FIG. 30 is a perspective view of a wall constructed from partition frames interconnected in an off-module arrangement.

The attachment of a two-inch FIN wall partition frame 101 to a four-inch Zone wall partition frame 81' is shown in FIGS. 27 and 29. A two-inch FIN wall partition frame 101 can also be attached to another two-inch Zone wall partition frame if desired (FIG. 27). For reference, the connection of a four-inch Zone wall partition frame 81' to another four-inch Zone wall partition frame is shown in FIGS. 1 and 30.

Figure 1:
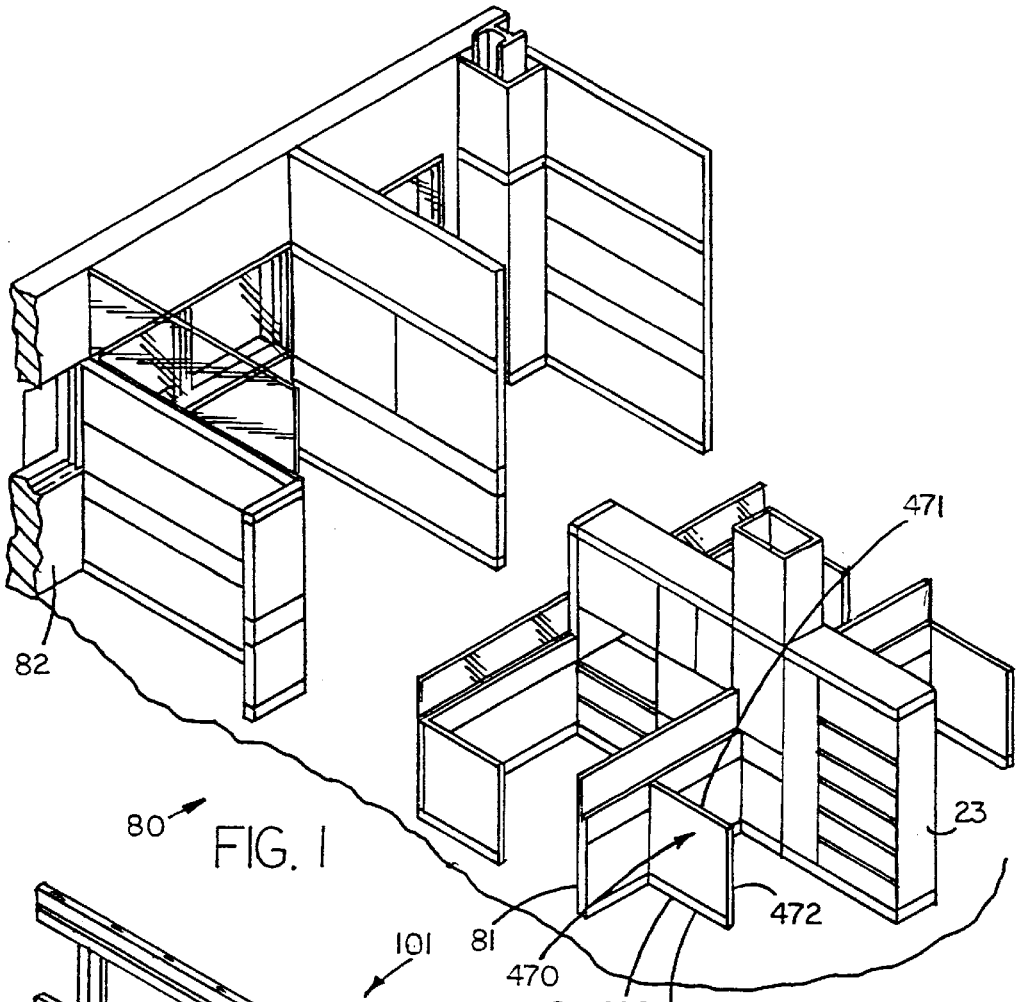
FIG. 1 is a perspective view of a furniture system including a partition construction embodying the present invention.

As is apparent by reviewing FIGS. 1 and 29, the four-inch Zone wall and two-inch FIN wall systems can be interconnected to form an infinite variety of office space arrangements optimally suited to particular office needs.

A modified off-module bracket 190 (FIG. 28) is shown for selectively engaging three slots simultaneously, such as slots 127, 128, or 155, or configured slots 129 or 158. Bracket 190 is particularly suited for selectively engaging a slot comprising abutting half slots such as slots 156 on two in-line connected partition frames 101 since it also engages slots on either side of the half slots 156. The illustrated bracket 190 is configured to connect a four-inch Zone wall partition frame 81' to an adjacent four-inch Zone wall partition frame 81' in an off-module position, as shown in FIGS. 29 and 30. This bracket 190 (FIG. 28) includes a top plate 191 and a bottom plate 192 slidably connected to top plate 191 by a pair of rivets 193 and 194. The plates 191 and 192 include a plurality of oppositely facing hooks 195 and 196, respectively, along one end, and include apertures 197 and 198 along an opposite end. The plates 191 and 192 are moveable along direction "A" between a collapsed first position wherein the hooks 195 and 196 are collapsed together allowing insertion of the hooks 195 and 196 into selected slots in a partition frame such as frame 101, and a second position wherein the hooks are spread apart for securely fixedly engaging the selected slots in the frame 101. The plates 191 and 192 can be held in the second spread-apart interlocked position by a number of different ways. For example, a screw or retainer clip can be used to engage the apertures 197 and 198 or the space 198" to retain plates 191 and 192 in the interlocked position. Alternatively, a spring 198' can be used to bias the plates 191 and 192 to the interlocked position, or a detent (not specifically shown) between the plates 191 and 192 can be used to frictionally retain the plates 191 and 192 in the interlocked position.

The plates 191 and 192 (FIG. 28) are stamped sheet metal parts bent into a Z shape when viewed from a side. The Z shape of bracket 190 is similar to the Z shape of the off-module bracket 169 (FIG. 22), so that the bracket 190 (FIG. 28) can be engaged with selected slots while a cover panel 210 is attached to the partition frame 101 (or frame 81' on the four-inch Zone wall 81). When attached, the middle section 199 of bottom plate 192 extends downwardly/vertically in a location abuttingly adjacent the outer surface of the cover panel, as discussed below. It is contemplated that the middle section 199 can be extended downwardly several inches or more (not specifically shown) to provide attachment structure for supporting furniture components such as shelves, binder bins, or other office accessories. Further, a pair of brackets 190 can be attached to the top and the bottom of an accessory frame for engaging top and bottom slots 156 in channels 106 of intermediate frame members 107 and 108, as described below. (See FIGS. 42 and 43 and also FIGS. 44 and 45.) Where the plates 191 and 192 of attachment brackets are spring-biased into the interlocked position, the hooks 195 and 196 are provided with angled surfaces 202 on the hooks 191 and 192 so that attachment can be accomplished simply by pressing the brackets 190 against the selected slots. Specifically, the angled surfaces 202 rampingly engage the slots 156 on the frame causing the plates 191 and 192 to move to a collapsed position. Once the brackets 190 are fully inserted and seated in the slots, the brackets 190 snap horizontally into the interlocked second position. The brackets 190 can be removed by using a tool to bias the plates to the collapsed position.

Removable cover panels 210 (FIGS. 33–40) are provided for covering the FIN wall partition frames 101. The same cover panels 210 can also be used for covering the four-inch Zone wall frames 81' and other frames incorporating a horizontal member with apertures therein configured for mating connection to the cover panels 210. For example, it is contemplated that structural members comparable to frame members 104, 105 or 106 could be separately attached to an existing permanent wall or a window-frame-type partition frame at selected vertical locations. Alternatively, frames 101 could be positioned/attached flat against an existing permanent wall and then covered with cover panels 210. Nonetheless, to facilitate the following discussion, the cover panels 210 are disclosed in regard to attachment to frame 101.

The cover panels 210 can be manufactured from a variety of materials and in a variety of shapes and sizes to provide various aesthetic appearances to satisfy aesthetic/decorative needs of particular customers and/or designers. For example, the cover panels can be constructed of relatively thin sheet metal or plastic panels and pan shaped/concavely shaped. Also, the cover panels can be constructed of relatively thick composite or particulate material covered with fabric or otherwise coated. Also, the cover panels can be constructed of wood, foam, laminate and numerous other materials. Each cover panel 210 (FIG. 33) includes a main panel 211. Where extra strength is desired, a metal perimeter frame 212 is attached to the main panel 211. The perimeter frame 212 includes a top section 213 located along an upper rear side of the main panel 211, and further includes a bottom section 214 located along a lower rear side of the main panel 211.

Figure 34:
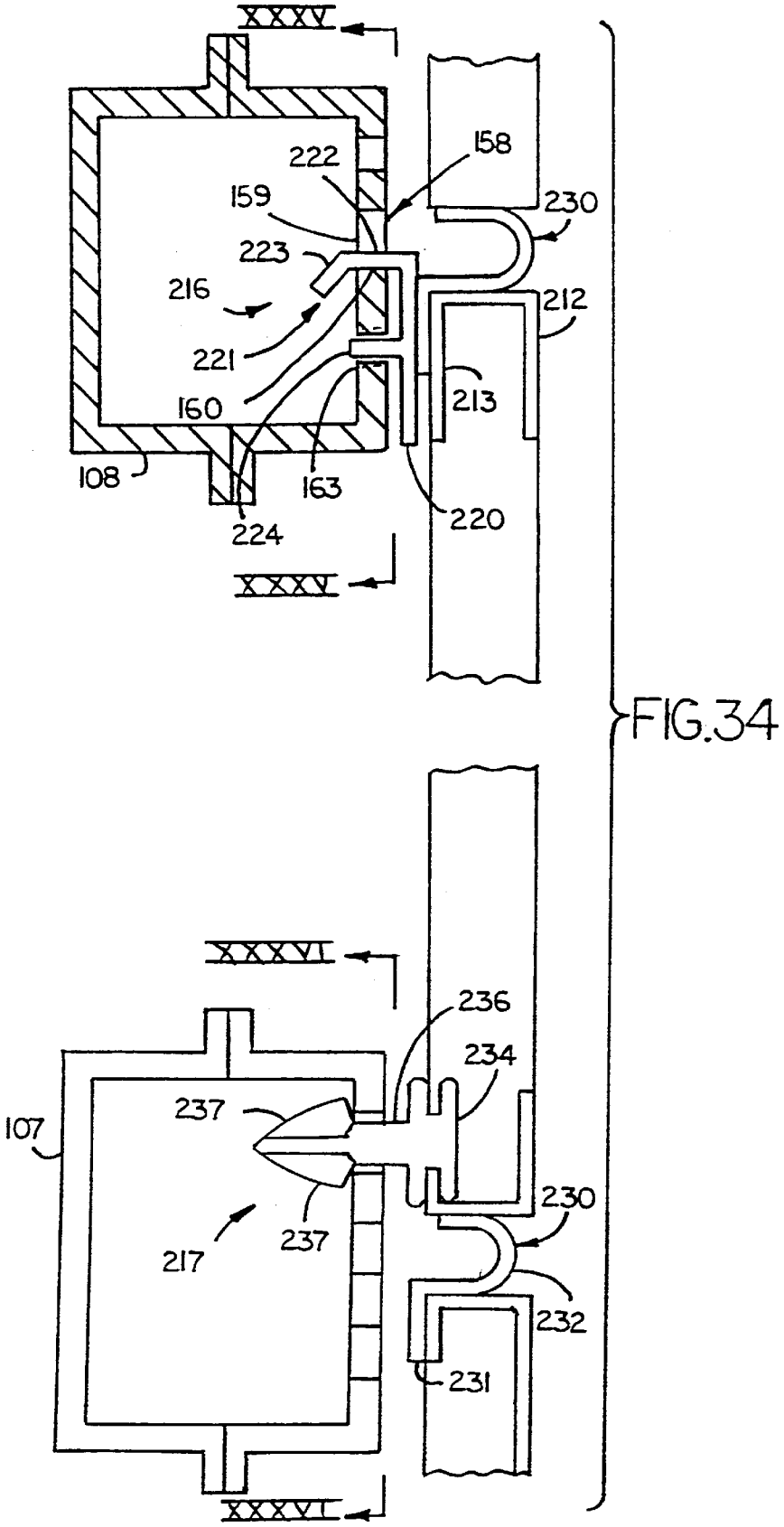
FIG. 34 is a fragmentary cross-sectional side-elevational view of a cover panel attachment construction.
Figure 33:
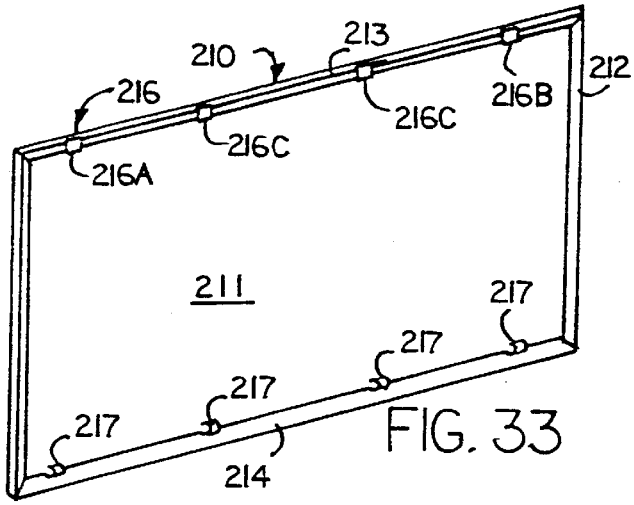
FIG. 33 is a perspective view of a cover panel.
Figure 35:
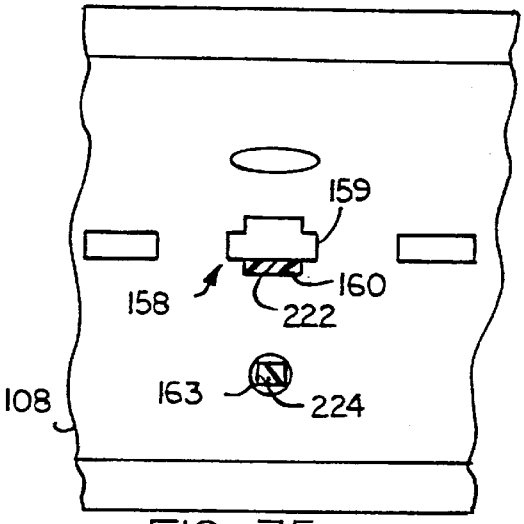
FIGS. 35 and 36 are fragmentary cross-sectional views taken along the lines XXXV—XXXV and XXXVI—XXXVI, respectively, in FIG. 34.
Figure 36:
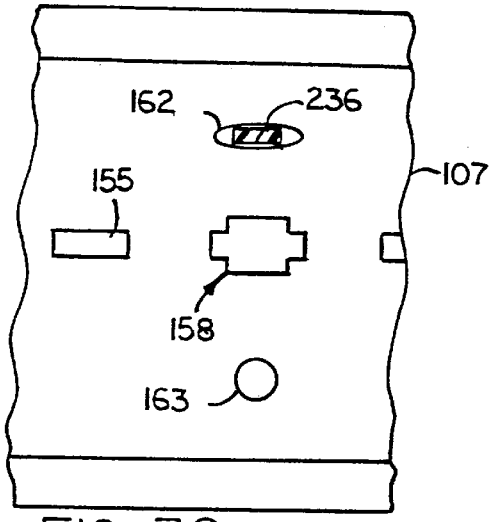
Figure 37:
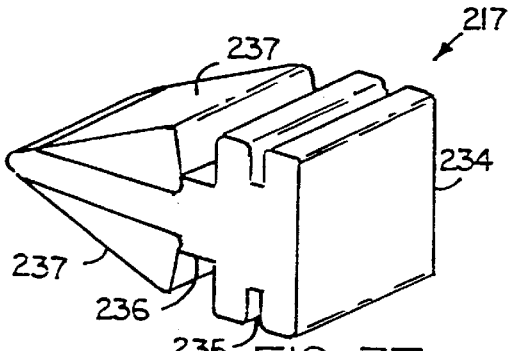
FIG. 37 is a perspective view of the friction post shown in FIG. 34.
Figure 38:
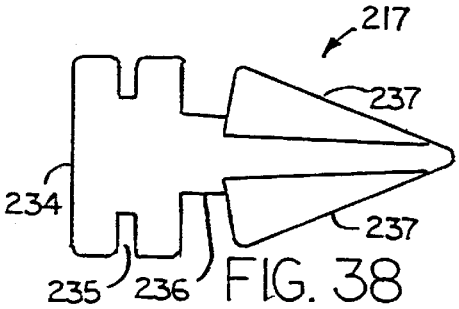
FIG. 38 is a side view of the friction post shown in FIG. 37.

Each cover panel 210 includes an attachment scheme including upper locators/connectors 216 and lower friction posts 217. The frame members in FIG. 34 are generally referred to by the numbers 107 and 108, but it is noted that any horizontally extending partition frame member could be used that has an outer flange with the previously disclosed horizontal row of apertures and holes, such as any of the frame members 104, 105, and 107–109 (and 106) on partition frame 101 (FIGS. 2 and 3), and also such as the apertured horizontal frame members on the four-inch Zone wall partition frame 81' (FIG. 29).

Upper locators/connectors 216A, 216B, and 216C (FIG. 33) (generically identified as connector 216 in FIG. 34) each include a flat section 220 (FIG. 34) for attachment to the top rear section 213 of perimeter frame 212, such as by adhesive or welding. A locator tab 221 is bent from flat section 220, and includes a horizontal section 222 for extending through a configured aperture such as aperture 158 of frame 101, and a downwardly angled rear section 223. The locator tab 221 is shaped to drop mateably into the smaller lower section 160 of configured aperture 158 (FIG. 32) so that it accurately locates cover panel 210 on partition frame 101. An anti-dislodgement tab 224 (FIG. 34) is optionally formed on locator/connector 216 a predetermined distance below locator tab 221 so that the anti-dislodgement tab 224 engages hole 163 in frame member 218 below configured aperture 158 as the cover panel 210 is pivoted into a vertical secure position. Anti-dislodgement tab 224 holds locator tab 221 in the small lower section 160 (FIG. 32) of configured aperture 158, thus leaving the enlarged slot-forming center section 159 of configured aperture 158 open for engagement by a separate bracket.

Connectors 216A, 216B, and 216C (FIG. 33) are particularly located on cover panels 210 as follows. The upper left connector 216A includes a locator tab or locator/connector 221A having a width that fills the lower section 160 of aperture 158 (FIG. 32), so that it horizontally and vertically locates the upper left corner of the cover panel 210. When assembled to frame 101, the locator tab 221A does not encroach into the center section 159 of configured aperture 158, so that a bracket such as brackets 169 or 190 can be engaged with the middle sections 159 for supporting an off-module panel. The right connector 216B (FIG. 33) is equal in horizontal height to connector 216A on cover panel 210, but the locator tab 221 on the right connector is narrower than on connector 216, such that it provides horizontal clearance to allow for manufacturing dimensional variations between locator tabs 221A and 221B. The center connectors 216C are located slightly higher than the left and right connectors 216A and 216B on skin 216 to prevent teeter-tottering of the cover panel 210 about the center location. This is particularly important where only a singe center connector is used. The center connector(s) 216C holds cover panel 210 against the frame 101 so that the cover panel 210 does not tend to bulge outwardly in the middle.

The friction posts 217 (FIGS. 37 and 38) each include a base portion 234 with slots 235 configured to engage retention flanges on bottom section 214 of cover panels frame 212. A stem 236 extends from base portion 234, and a pair of friction-generating patches 237 are formed on opposing sides of an end of stem 236. Stem 236 has a rectangular cross section signed to substantially fill the aperture 162. Base portion 234 and stem 236 are integrally molded of a relatively stiff polymeric material, and friction-generating patches 237 are coextruded therewith of a lower/deformable polymeric material. Notably, stem 235 has a width and is solid, such that it does not tend to tip or deform to a side during installation. It is further contemplated that the sides of stem 235 could include additional undulations or a roughened configuration, and/or the dimension of stem 235 could be oversized to provide a continuous interference fit within the aperture into which it is placed. Another contemplated known friction-type fastener includes reversely angled radially extending fins along its shaft. Such fasteners are commonly referred to as a "Christmas tree" fastener, and are commonly used to retain seat back covers to seat backs, and also to retain automobile door panels to car door frames.

Cover panel 210 (FIGS. 34 and 35) is attached by positioning upper locator/connector 216 in the lower smaller section 160 of configured aperture 158. As cover panel 210 is pivoted to a vertical position, stud 234 engages an aperture 162 in the lower frame member 218 (FIG. 35) to hold cover panel 210 in place against partition frame 101. In the vertical position, the anti-dislodgement tab 224 (FIG. 34) engages hole 163 and holds locator/connector 216 downwardly in the smaller section 160 of configured aperture 158. Notably, a plurality of configured apertures 158 and apertures 162 and 163 are located along frame member 218, such that cover panel 210 can be installed in any of a variety of different discrete positions along partition frame 101. Thus, the cover panel 210 can be repositioned along the frame 101 in an optimal position relative to any off-module positioned frame.

An elongated flexible strip 230 (FIG. 34) can be inserted between adjacent cover panels 210 to aesthetically cover the space between the vertically adjacent cover panels. The strips 230 include an L-shaped rear section 231 for retaining the strips behind a cover panel 210, and further include a U-shaped resilient flap 232 that is doubled back and that extends along the adjacent edges of the upper and lower cover panels 210 to block light. When desired, the L-shaped rear section 231 is attached to the top edge of a cover panel 210. Alternatively, the strip 230 can be a separate part. Resilient flap 232 is flexible so that it can be flexed away for accessing a configured aperture 158.

A whiteboard or erasable marker board construction 275 (FIG. 39) is provided that includes a whiteboard panel 276 secured to frame 101 by top and bottom channels 286 and 287 by permanent push-pin rivets 288. The whiteboard 278 is covered with a material providing an erasable surface 279.

A tray 282 is incorporated into the bottom channel 287 and extends outwardly, such as for holding markers or the like for marking on the whiteboard 276. It is contemplated that tray 282 could also comprise a relatively small shelf adhered to a face of whiteboard 276, or could be a separate shelf attached to frame member 106, such as by a bracket comparable to bracket 190 that engages selected ones of the slots 155/configured apertures 158 on frame member 106.

Figures 39, 41:
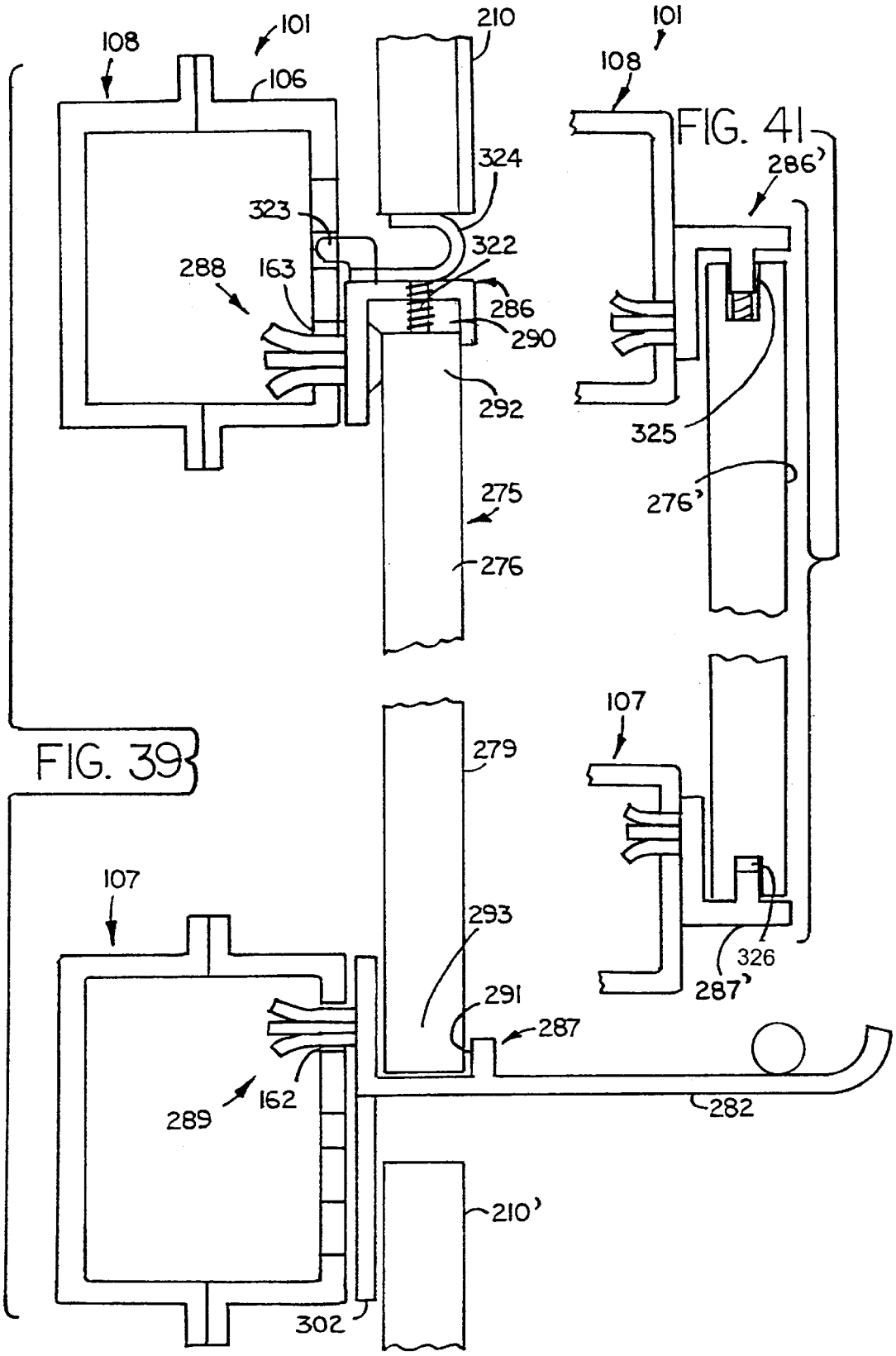
FIG. 39 is a fragmentary cross-sectional side-elevational view of a permanently attached white board/erasable writing board.
FIG. 41 is a fragmentary cross-sectional side elevational view of a modified attachment construction for a white board.
Figure 47:
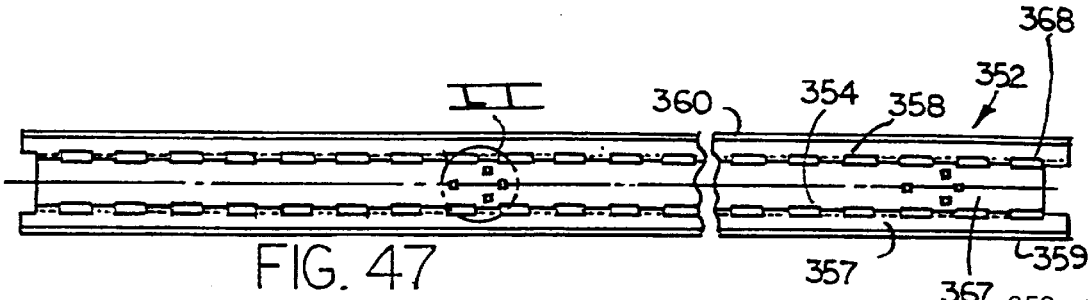
FIGS. 47–49 are fragmentary top, side, and end views of a floor-engaging member for a floor channel.

Upper channel bracket 286 includes flanges forming an inverted downwardly facing U-shape. Bracket 286 is attached to frame member 106 by permanent metal push-pin rivets 288 that extend through a hole in the rear vertical flange of upper channel bracket 286 into holes 163 (or holes 162 or 165) in frame 101. Lower channel bracket 287 (FIG. 47) defines an upwardly facing U-shape, and is attached to another portion of frame 101 below upper channel bracket 286 by identical permanent push-pin rivets 289 that extend through lower channel bracket 287 into holes 162 (or 163 or 165) in the second frame member 106. Rivets 288 (and 289) each include a head 288A (FIG. 40), a pair of deformable legs 288B, and a push pin 288C configured to spread the legs 288B and permanently deform the legs when pushed through head 288A. Advantageously, the permanent push-pin rivets 288 and 289 allow quick installation but provide secure permanent attachment for safety reasons. Upper and lower channel brackets 286 and 287 define opposing horizontally elongated recesses 290 and 291 for receiving top and bottom edges 292 and 293 of board 285. Board 285 is attached to channels 286 and 287 by inserting its upper edge 292 into the top recess 290, by pivoting board 285 to a vertical position, and then by dropping board 285 downwardly so that lower edge 293 engages lower recess 291. Of course, top recess 290 in the upper channel bracket 286 must be deep enough so that the whiteboard 275 does not come out of the recess 290 when the whiteboard 275 is set into lower recess 291. Notably, relatively heavy accessories or accessories that will be written on or wiped can be supported on frame 101 in this manner. The bottom channel bracket 287 also optionally includes a stabilizer 302 comprising a finger or tab that extends behind an upper edge of a below-adjacent cover panel 210', as shown in FIG. 39. The upper channel bracket 286 optimally includes at least one threaded set screw 322 that can be extended to press downwardly against whiteboard panel 276 to hold whiteboard panel 276 securely downwardly against bottom channel bracket 287. Optionally, a locator 323 is incorporated into channel bracket 286 to engage aperture 158/159 to locate channel bracket 286 on frame 101. A light shield or flap 324 along the top of channel bracket 286 engages a bottom of an above-located cover panel 210 for aesthetics.

A modified arrangement (FIG. 41) includes top and bottom channel brackets 286' and 287' having a modified outer flange configured/positioned to telescopingly engage top and bottom marginal recesses 325 and 326 in the top and bottom edges of whiteboard panel 276'. This arrangement hides the outer flanges of channel brackets 286' and 287', thus providing a potentially cleaner appearance to the assembly.

A slat wall panel 330 (FIG. 43) defining a plurality of releasably engageable slots 331 can be permanently pivotally attached to frame 101 by a hinge 332, such as at a workstation along a rear edge of a worksurface. Slat wall panels and brackets for engaging them are generally known in the art and need not be described herein in detail to understand the present construction. Hinge 332 includes a first hinge part 333 permanently secured to frame member 107 by push-pin rivet 288. A second hinge part 334 is welded to the back of slat wall panel 330. Hinge parts 333 and 334 are pivotally secured together by a hinge pin 335 at a location generally above push-pin rivet 288. The hinge pin 335 and associated pin-supporting structure on hinge parts 333 and 334 are spaced forwardly of the outer surface of frame member 107 to define a space 335 therebetween. An L-shaped flange 336 includes a free end 337 that extends into the space 335 as slat wall 330 is pivoted to an open position, such as when slat wall 330 is pivoted outwardly to access wiring within frame 101.

The bottom of slat wall panel 330 is held by friction posts 217 previously described. (See FIGS. 34 and 37–38).

Another permanently attached hinged slat wall 339 (FIGS. 44 and 45) includes an L-shaped hinge part 340 attached to frame member 108 by push-pin rivet 288. A second hinge part 341 is welded to a back of slat wall panel 342. Notably, hinge part 341 can be extended to form a stiffener on the back side of slat wall panel 342. A hinge pin 343 pivotally connects hinge parts 340 and 341 at a location generally below push-pin rivet 288. A rearwardly facing C-shaped channel 344 includes a lower flange 345 secured between attachment tabs 346 on hinge part 340. The upper and outer flanges 347 and 348 of channel 344 aesthetically trim out the upper edge of slat wall 339. Outer flange 348 includes a lip 348A that forms a top edge of the uppermost slot 349 on slat wall 339.

Figure 46:
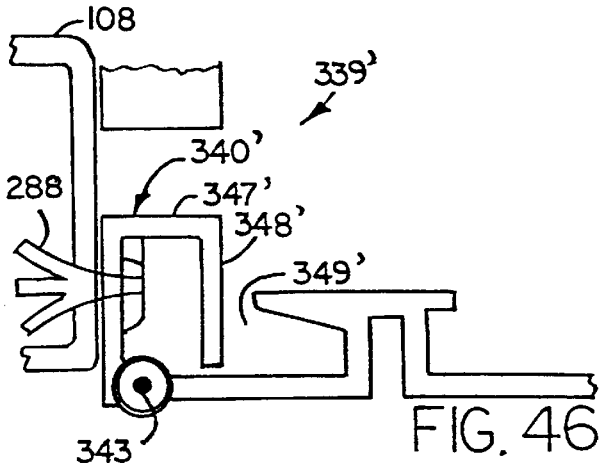
FIG. 46 is a fragmentary cross-sectional view of another modified permanently attached, hinged slat wall.

Slat wall 339' (FIG. 46) is comparable to slat wall 339, but in slat wall 339' the upper and outer flanges 347' and 348' are incorporated into upper hinge part 340' such that the hinge part 340' has a downwardly facing C-shaped section. Outer flange 348' of hinge part 340' includes a hole so that push-pin rivet 288 can be moved through outer flange 348' into position to secure upper hinge part 340' to frame member 108. Outer flange 348' forms the upper attachment flange of the uppermost slot 349' on slat wall 339'.

Figure 59:
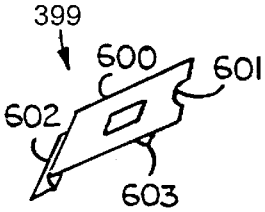
FIGS. 59 and 60 are perspective and side views of a resilient locking clip.
Figure 60:
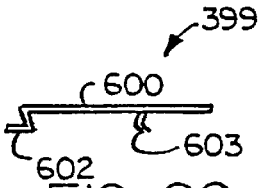
Figure 54:
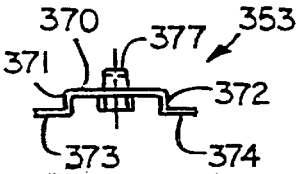
FIGS. 52–54 are fragmentary top, side, and end views of a hat-shaped channel for a floor channel.
Figure 52:
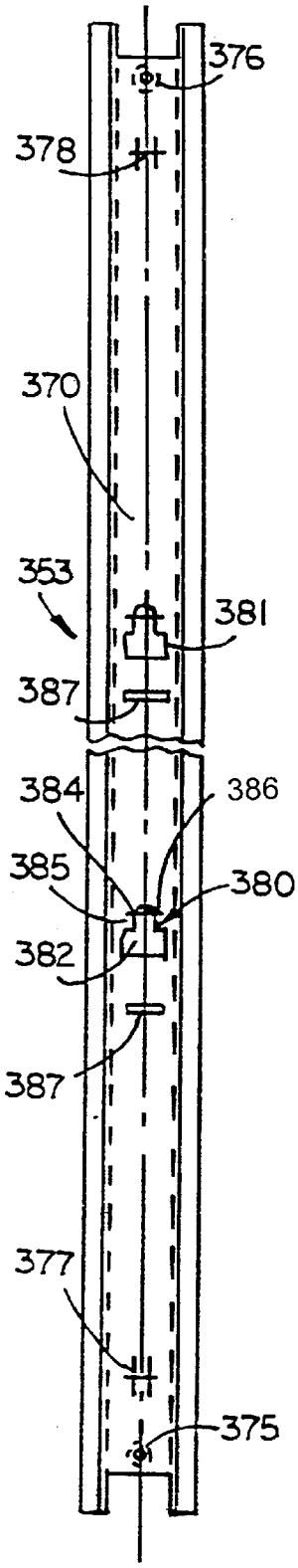
Figure 53:
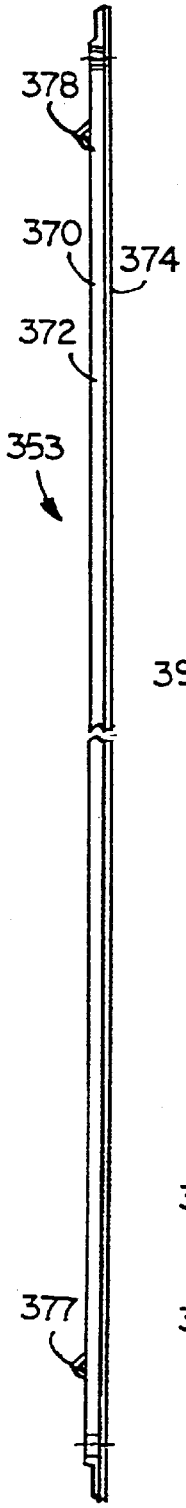
Figure 55:
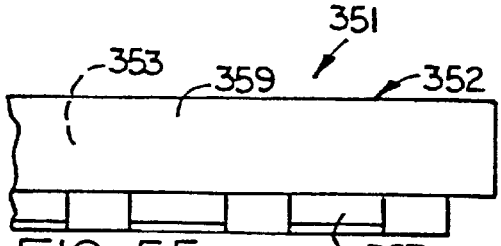
FIGS. 55 and 56 are side and end views of a floor channel including the floor-engaging member of FIG. 49 and the hat-shaped channel of FIG. 54.
Figure 56:
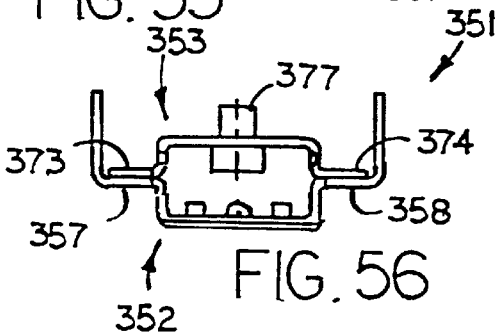
Figure 57:
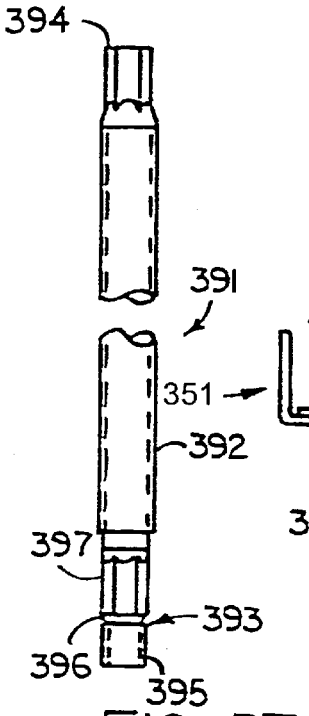
FIG. 57 is a side view of a leveler for the partition frame of FIG. 2.
Figure 58:
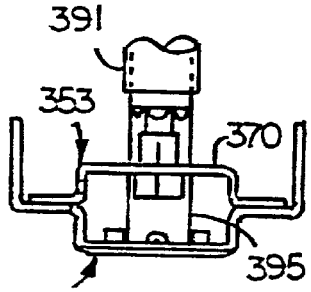
FIG. 58 is an end view of the leveler of FIG. 57 engaged with the floor channel of FIG. 56.
Figure 61:
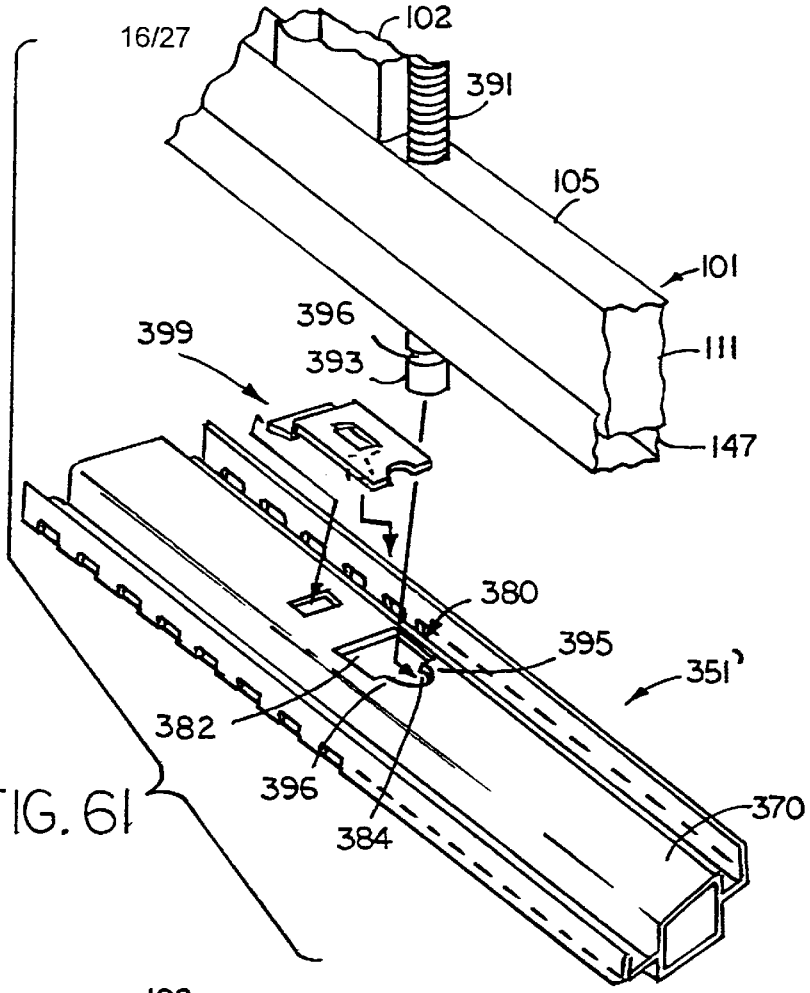
FIG. 61 is an exploded perspective view of a partition frame of FIG. 2 including the leveler of FIG. 57 and a locking clip of FIG. 59 exploded from the floor channel of FIG. 56.
Figure 68:
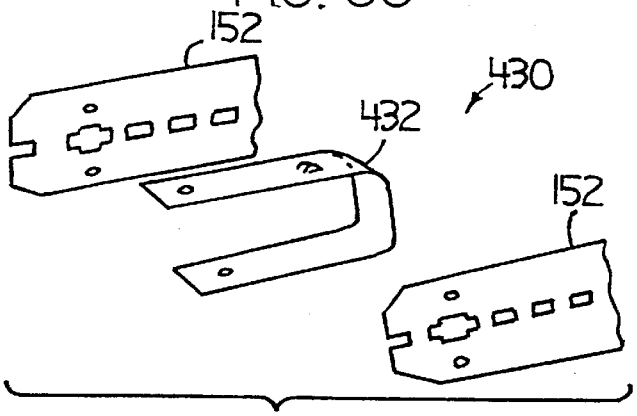
FIG. 68 is a fragmentary exploded perspective view of the modified end section of the modified partition frame of FIG. 65.

The partition frame 101 is attached to a floor or support surface by engagement of a leveler system 350 on partition frame 101 (FIGS. 2 and 68) with a floor channel 351 adapted to releasably engage leveler 350. Specifically, floor channel 351 includes a floor-engaging channel 352 (FIGS. 54–58) and a hat-shaped stiffener/retainer channel 353 (FIGS. 59–61) welded thereto. Floor-engaging channel 352 (FIG. 56) includes an elongated channel having a flat center flange 354, inside flanges 355 and 356 that extend upwardly, side "shelf" flanges 357 and 358 that extend horizontally, and outside flanges 359 and 360 that extend vertically. Center flange 354 is cut short of the ends of flanges 355–360 (FIG. 54) to facilitate a tight assembly to adjacent floor channels 351. Two patterns of tabs are formed in center flange 354, including three tabs 362–364 defining three sides of a location 365, and a fourth tab 366 spaced longitudinally a short distance away from location 365. A row of slots 367 are formed along the corner formed by center flange 354 and vertical inside flange 355, and another row of slots 368 are formed along the corner formed by center flange 354 and vertical inside flange 356. The slots 367 and 368 are selectively engageable by off-module brackets 169 for attaching a FIN wall partition frame 101 thereto, or are selectively engageable by off-module brackets 190 for attaching a four-inch Zone wall partition frame 81' thereto.

Figure 48:
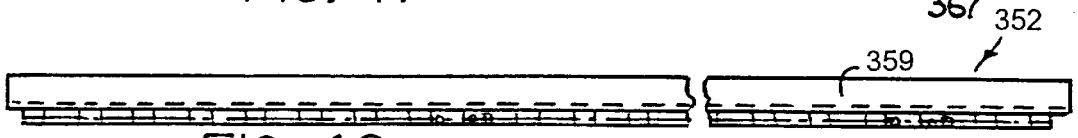
Figure 49:
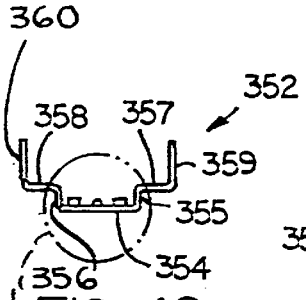
Figure 50:
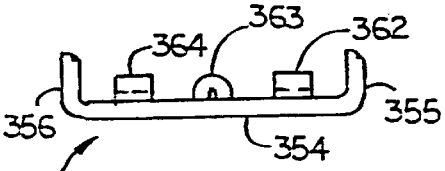
FIG. 50 is an enlarged fragmentary view of the circled area L in FIG. 49.
Figure 51:
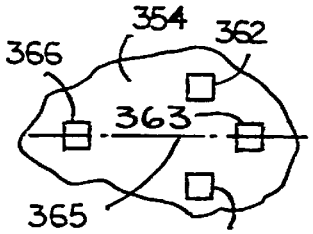
FIG. 51 is a fragmentary top view of the circled area LI in FIG. 47.

The hat-shaped stiffener/retainer channel 353 (FIGS. 47–49) includes a center flange 370, downwardly extending side flanges 371 and 372, and horizontally/outwardly extending wing flanges 373 and 374. Extruded holes 375 and 376 are formed in each end of center flange 370 proximate the ends of center flange 370. Extruded holes 375 and 376 are located to receive the rear end 172 of off-module connector 169, so that a screw can be extended through the space 180 in connector rear end 172 into extruded hole 375 to retain the bottom of an off-module connected partition frame 101 to another partition frame 101 in a perpendicular arrangement (see FIGS. 27 and 29). Extruded holes 375 and 376 can also be used to connect the ends of a straight flat connector (not specifically shown) extended between aligned floor channels 350. Pyramid-shaped protrusions 377 and 378 are formed in center flange 370 inboard of extruded holes 375 and 376. The protrusions 377 and 378 form stops for locating/orienting the off-module connector on the adjacent center flange 370.

A pair of key holes 380 and 381 are formed in center flange 370 at locations offset from but generally corresponding to the locations of the bottoms of frame uprights 102 and 103. Key holes 380 and 381 each include an enlarged end 382 and a smaller end 384. Marginal material 385 and 386 forms the sides of the smaller end 384. A slot 387 is located in center flange 370 spaced from enlarged end 382 of each of key holes 380 and 381.

Figure 65:
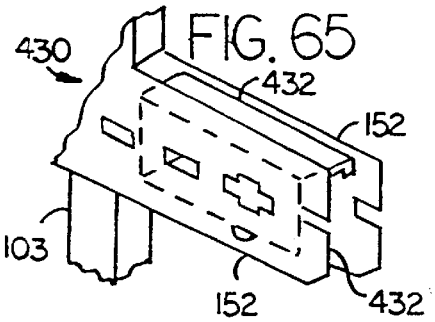
FIG. 65 is an enlarged perspective view of the modified end section of the partition frame shown in the circled area LXV in FIG. 64.
Figure 66:
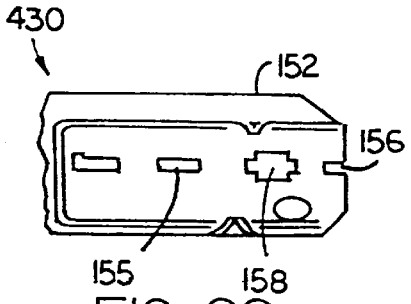
FIGS. 66 and 67 are fragmentary side and end views of the modified end section of FIG. 65.
Figure 67:
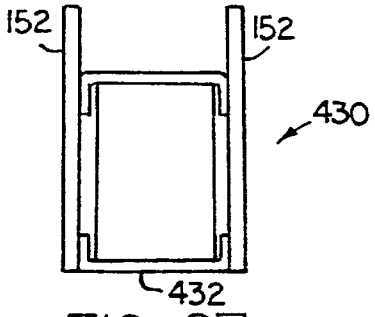

The floor channel 351 is assembled by placing hat-shaped retainer channel 353 onto floor-engaging channel 352 (FIG. 56), with the wing flanges 373 and 374 of hat-shaped retainer channel 353 resting on the "shelf" flanges 357 and 358 of floor-engaging channel 351. Wing flanges 373 and 374 are then welded to "shelf" flanges 357 and 358. Where required by local code, floor channel 351 can be secured to a floor surface by adhesive, nails, screws, or by other means known in the trade. For example, holes can be provided in the center flange 370 of hat-shaped retainer channel 353 so that nails can be driven through lower center flange 354 of floor engaging channel 352 into the floor surface. It is noted that the floor channel can include a modified cross section with a wider floor-engaging footprint than the channel 351 shown in FIGS. 64 and 65, while maintaining the functional features relating to the key hole and leveler systems the same.

Figure 62:
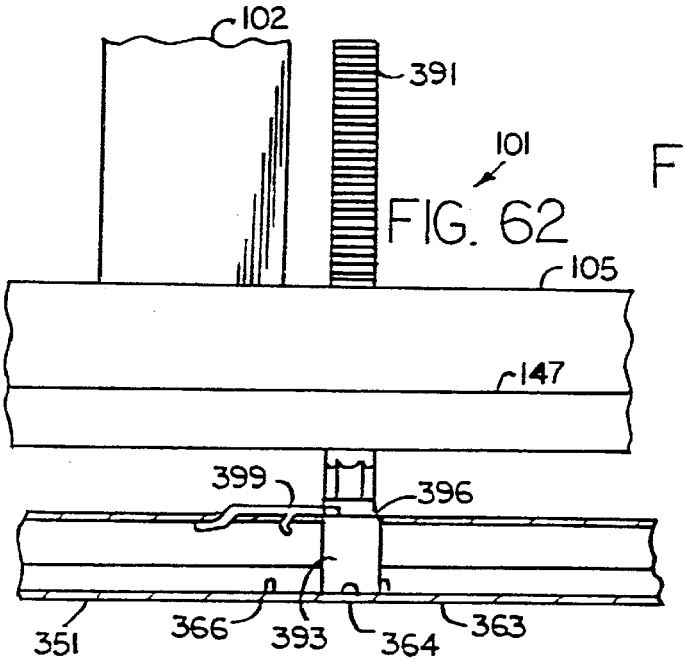
FIGS. 62 and 63 are side and end views of the partition frame with the leveler engaged with the floor channel of FIG. 56.

The leveler system 350 (FIG. 61) includes a leveler post 391 extended into threaded extruded holes 138 and 139 on lower frame member 105 of frame 101. A nut can be welded to tubular uprights 102 and 103 or to lower frame member 105 to provide additional support at the extruded holes 138 and 139, if desired. Alternatively, a different fabrication method can be used, such as a weld nut. The leveler post 391 (FIG. 57) includes a threaded center section 392, a lower foot section 393 and a hex head 394. Hex head 394 is configured to receive a hex-socket tool for rotating leveler post 391 to level partition frame 101. Foot section 393 comprises an enlarged dome-shaped/radiused bottom section 395, a circumferential groove 396 thereabove, and a hex-shaped section 397 above groove 396 for receiving an open-ended wrench for rotating leveler post 391. Leveler post 391 is threadably secured to upright 102 (or 103) at extruded holes 138 and 139 and extends therebelow. Foot section 393 (FIG. 62) is configured to fit into the enlarged end 382 such that groove 396 horizontally aligns with marginal material 385 and 386. Partition frame 101 can be slid horizontally longitudinally to move leveler foot section 393 into smaller end section 384 of key hole 380 (and 381). This moves foot section 393 to location 365 where it is captured by tabs 362–364. Also, marginal material 385 and 386 engages groove 396 to retain leveler post 391 to floor channel 351 as leveler post 394 moves to location 365. Marginal material 385 and 386 can include detents or inwardly extending tabs to frictionally retain leveler post 391 within the smaller section 384 of key hole 380 (and 381).

In addition to tabs 362–364, a spring clip 399 (FIG. 62) is engaged with floor channel to securely stably hold leveler post 391 in the smaller section 384 of key hole slots 380 and 381. Spring clip 399 includes a flat body 600 with an arcuate notch 601 at one end shaped to mateably engage leveler post 391, and an L-shaped foot 602 at the other end for engaging slot 387 in center flange 370. A resilient finger 603 extends below flat body 600 that is configured to resiliently grip the transverse marginal edge of enlarged section 382 of key holes 380 and 381 when foot 602 is engaged with slot 387. (See FIG. 62)

This arrangement advantageously allows the floor/channel 351 to be securely assembled to the partition frame 101 at the manufacturing site, and shipped with the partition frame 101 as a unit to the installation site. At the installation site, the floor channel 351 can be removed for attachment to a floor surface. Thereafter, the partition panel frame 101 can be reconnected to the floor channel 351 by using the above procedure. Notably, attachment of the partition frame 101 to the floor is often required by statute in geographic locations where earthquakes are likely. It is noted that a leveler system substantially identical to the presently disclosed leveler system can also be used on a four-inch Zone wall partition system or on other partition systems. A key hole leveler-retention system including a slidable plate can also be used.

A modified two-inch FIN wall partition frame 410 is shown in FIG. 64. Modified partition frame 410 includes components very similar to those of partition frame 101, but in partition frame 410, the configured apertures 158 are located continuously every inch along the horizontal length of the horizontal frame members, even at uprights 102 and 103. Notably, the apertures could be discontinued at the uprights 102 and 103 if desired.

A utility-supporting framework 415 (FIG. 64) is attached to partition frame 410. H-shaped framework 415 includes vertical legs 416 and 417 connected at their top and bottom ends to horizontal frame members 418 and 419 by screws extended through the ends into lower holes 165 in upper frame member 108', and into upper holes 165 in lower frame member 107'. An energy module 420 is mounted on framework 415, and includes a pair of electrical power outlets 421, and a telecommunication terminal 423. A flexible power conduit 425 extends from energy module 420.

An alternative end section 430 (FIG. 64) is formed on horizontal frame member 108' of two-inch FIN wall partition frame 410. The alternative end section 430 is formed by cutting away the center of the ends of frame member 108' outboard of uprights 102 and 103, such that only the center flanges 152 of side channels 106 extend beyond uprights 102 and 103. A U-shaped band 432 (FIG. 68) is arcuately fit between center flanges 152, and is welded in place. The band 432 includes the same detailed features as the corresponding structure on partition frame 101, but advantageously band 432 can be made of a thicker and stronger material than the remainder of channel 106. Further, the band 432 can be accurately welded in a precise location with respect to the other end of horizontal frame member 106. Notably, the alternative end section 430 can be formed at any of the ends of intermediate horizontal frame members 107 and 108.

TRIM SYSTEM

The present invention includes a trim system attachable to the presently disclosed two-inch Zone Wall, the four-inch Zone Wall, and the Plus Wall system. The trim system has a clean squared architectural appearance that compliments the Wall systems' appearance, and further that meets the footprint/dimensional envelope strategy of the wall system, as discussed below. Specifically, the major trim components stay within the unitary "building block" dimensional envelope in a manner that simplifies and facilitates design and assembly. At the same time, the trim system highlights the Zone wall systems with an architectural look characterized by clean lines.

LOWER TRIM ATTACHMENT ALONG BASE BOARD TO FLOOR CHANNEL

The lower trim 400 advantageously attaches directly to the floor channel 351, or slidably attaches to partition frame 101. This allows the partition panel 100 to be maintained against the floor for optimal appearance. At the same time, the attachment of the lower trim 400 provides a tight assembly against the partition panel per se, thus providing optimal appearance.

Figure 63:
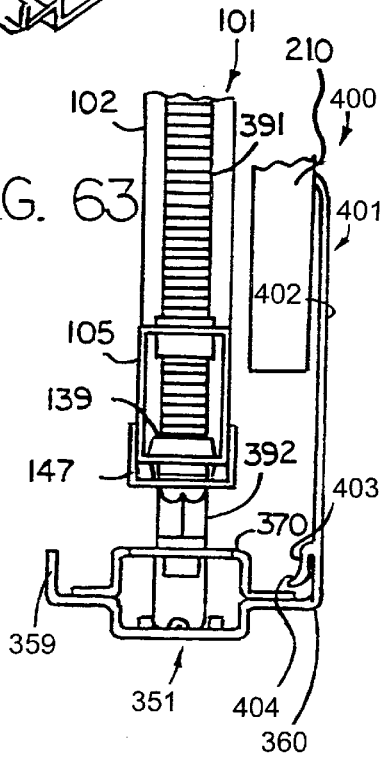
Figure 69:
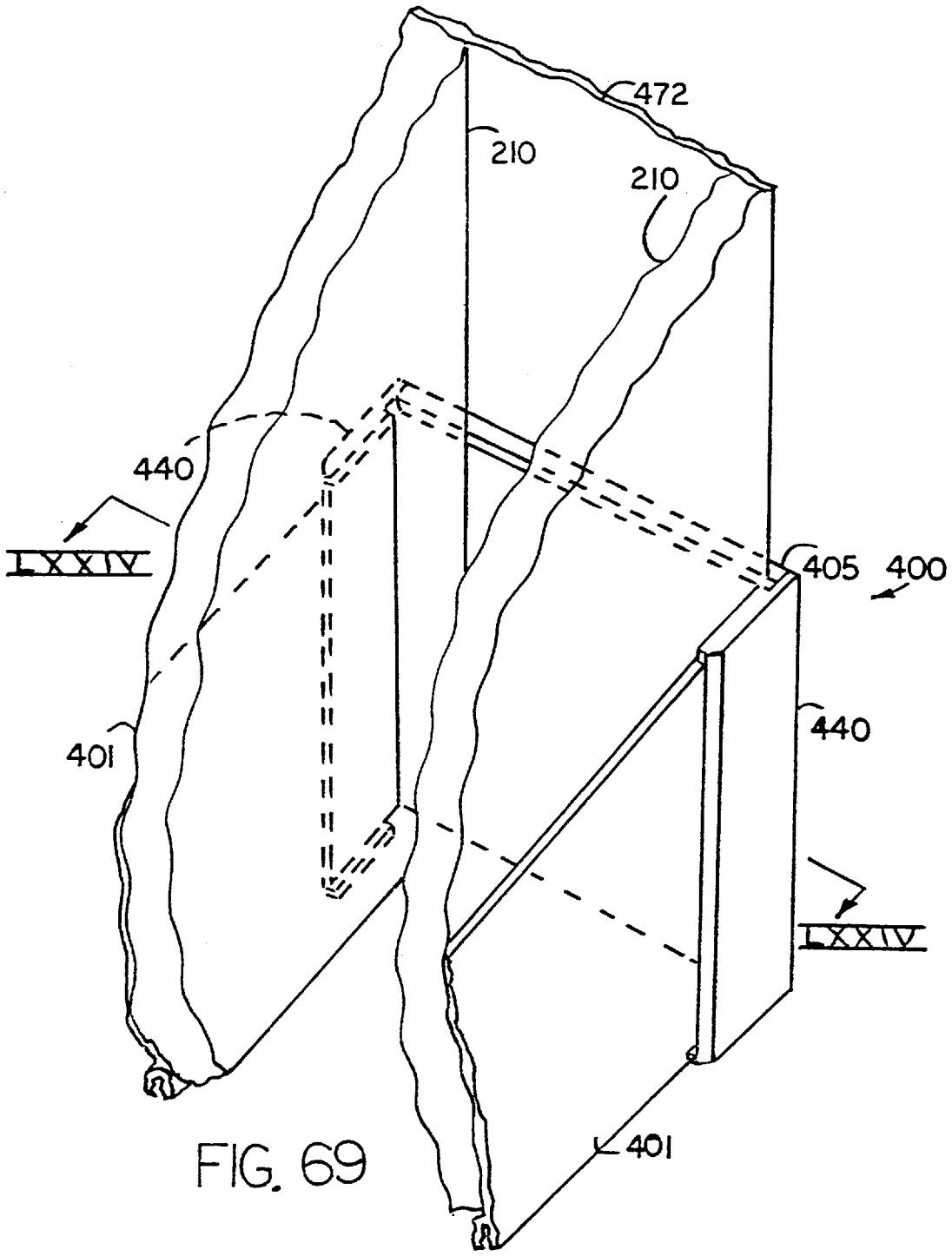
FIG. 69 is a schematic fragmentary perspective view of a lower end of a partition panel, the partition frame and the inside detail of the base trim having been removed to better show the relationship of the lower base trim to the cover panels.
Figure 70:
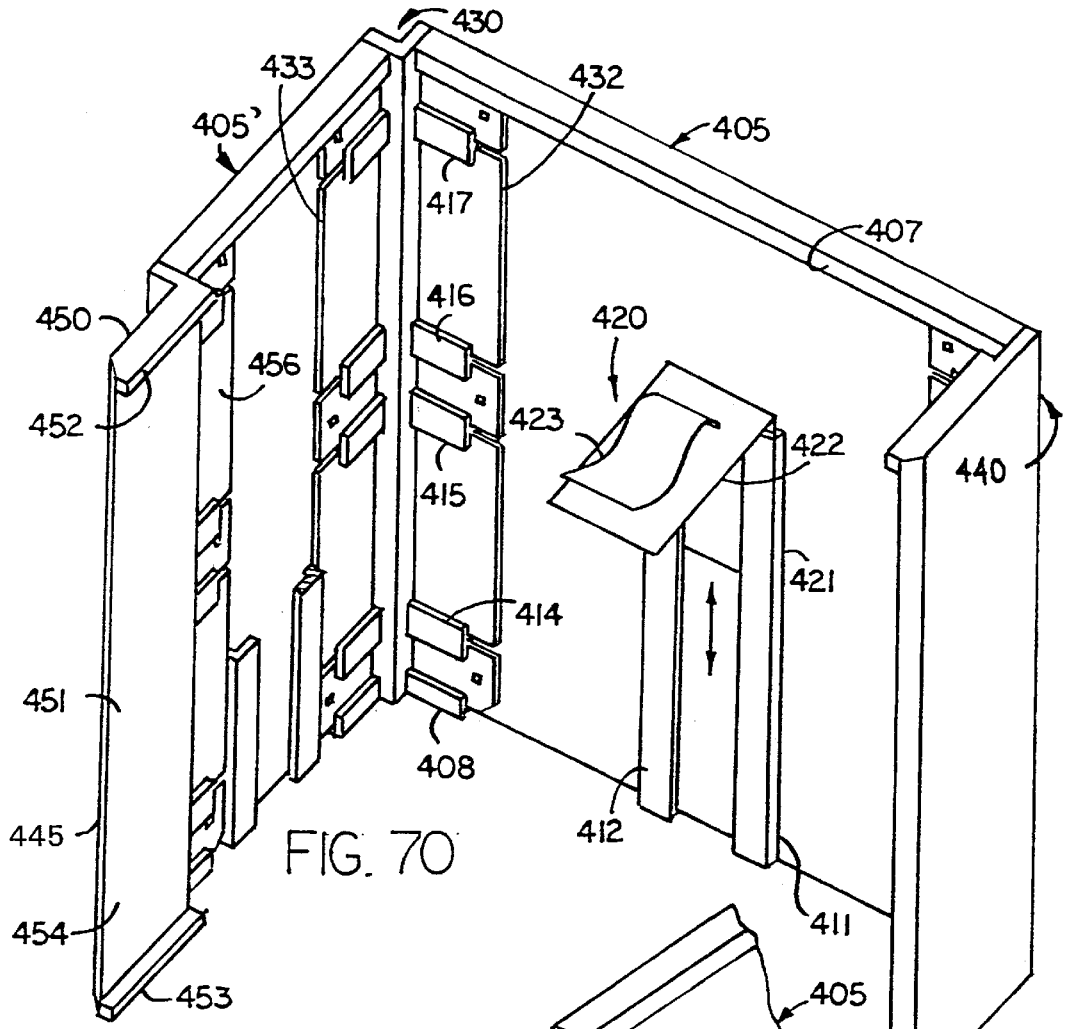
FIG. 70 is a perspective view of the base end trim including a four-inch base end shoe, a 90 degree spat connected to one side, a corner extender/connector connected to another side, and a two-inch end second shoe and an in-line spat connected to the extender/connector.
Figure 75:
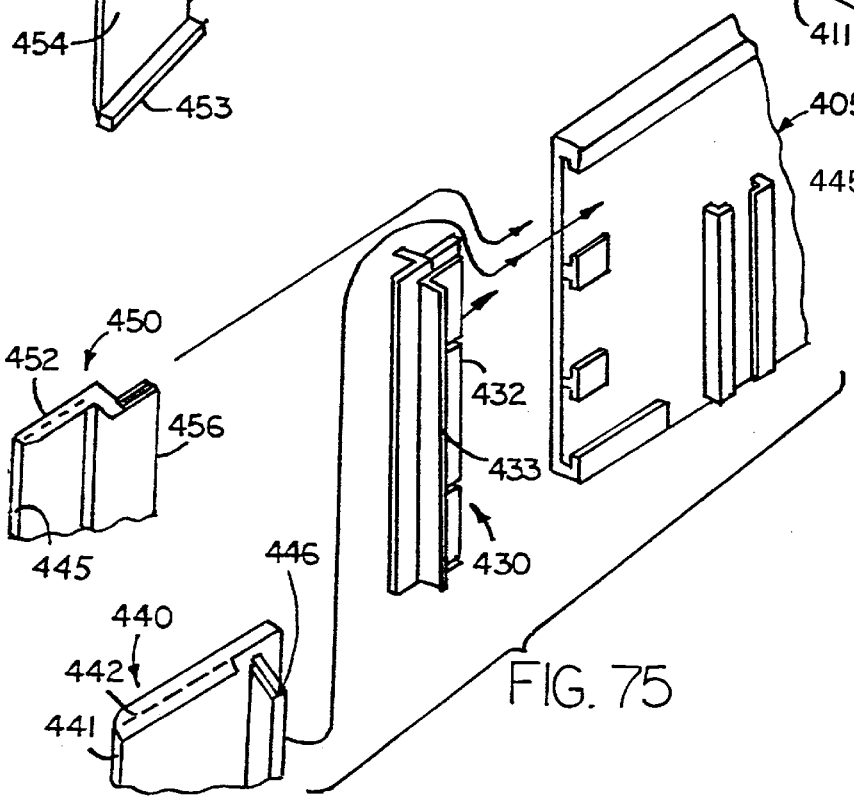
FIG. 75 is an exploded perspective view showing alternative interconnections of a base trim shoe, an extended/connector, a 90 degree spat, and an in-line spat.

Lower trim 400 includes a floor-engaging base trim cover 401 (FIG. 69) for engaging an upwardly extending outer flange 359/360 (FIG. 63) on the floor channel 351. The floor-engaging base trim cover 401 has an elongated flat body 402. A resilient leg 403 extends from the inside bottom of the flat body 402, and forms an inwardly facing "h" shaped cross section therewith. The resilient leg 403 is biased against the flat body 402, but includes an angled leading lower edge 404 forming a throat. By pressing the "h" shaped section downwardly onto the upwardly extending outer flange 359 (or 360) on the floor channel 351, the upwardly extending outer flange 359 (or 360) is forced between the resilient leg 403 and the flat body 402, thus attaching the floor-engaging base trim cover to the floor channel. The "h" shaped cross section is slightly canted with respect to the flat body 402 so that, when the base trim cover 401 is attached to the floor channel outer flange 359 (or 360), the flat body 402 is biased against the outer surface of the panel cover 210 of the partition frame 101. This substantially eliminates any unsightly gaps between the upper edge of the base trim cover 401 and the panel cover 210. The end of the base trim cover 401 tucks under the 90 degree spat (or the in-line spat), to provide an aesthetic termination, as described below and shown in FIG. 70. This construction allows base trim cover 401 to adjust so as to take up visual gaps due to an uneven floor.

The lower trim also includes a base end trim piece or "shoe" 405 (four-inch wide) or 405' (two-inch wide) (FIG. 71) having a plate-like body 406. The body has L-shaped flanges 407 and 408 along its top and bottom edges that define a pair of horizontally engageable tracks 409 and 409' engageable along lines 410 and 410', respectively. The bottom L-shaped flange is cutaway along a bottom center section, and two vertical L-shaped ridges 411 and 412 extend from the bottom edge upwardly over half way up the inside of the body 406. The vertical L-shaped ridges 411 and 412 form a second track 413 that is vertically telescopingly engageable along line 414' by spring clip 420. A plurality of laterally facing T-shaped sections 414–417 are located along the side edges of the body 406 on its inside surface. These laterally T-shaped sections 414–417 combine with L-shaped flanges 407 and 408 to receive respective portions of the connector blades to provide a very secure connection to mating pieces as noted below.

Figure 72:
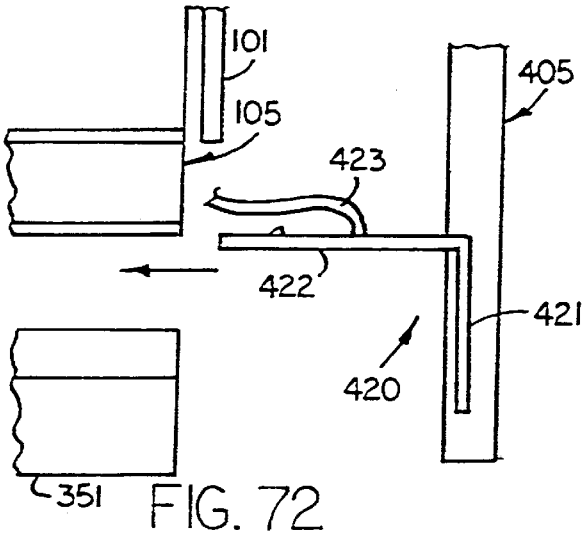
FIG. 72 is an exploded fragmentary side elevational view showing the attachment of a base end shoe to a partition frame.
Figure 73:
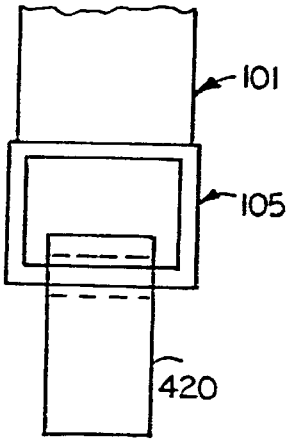
FIG. 73 is an end view of the attachment of a spring clip on the base end trim to the partition frame shown in FIG. 72.

An L-shaped metal clip 420 (FIGS. 71–73) is provided for securing the shoe 405 to an end of the partition frame 101.

The clip 420 (FIG. 71) includes a first leg 421 configured to vertically slidingly engage the vertical second track 413. A second leg 422 extends generally perpendicularly at about 87° to 88° to the first leg 421 (i.e. so that the top edge of shoe 405 is biased tight against the end of frame 101). A resilient S-shaped tab 423 is formed on second leg 422. The tab 423 defines with the second leg 422 an angled inlet throat 424, a pinch point 425, and a resilient support section 426. The tab 423 is configured to receive a horizontal wall section 148 of bottom frame member 105 on the partition frame 101, with the horizontal wall section 148 being slid through the throat 424 and past the pinch point 425. The first leg 421 slidably vertically engages the shoe 405, such that the shoe 405 can be slidingly adjusted downwardly against the floor to stay proximate the floor even when the height of frame 101 is adjusted by leveler system 350. This allows shoe 405 to be simultaneously held tight against cover panels 210 and be attached to the partition frame 101, yet be vertically adjustable. Thus, the attachment has an improved appearance over other partition systems where base trim disadvantageously moves with the partition frame itself.

Figure 71:
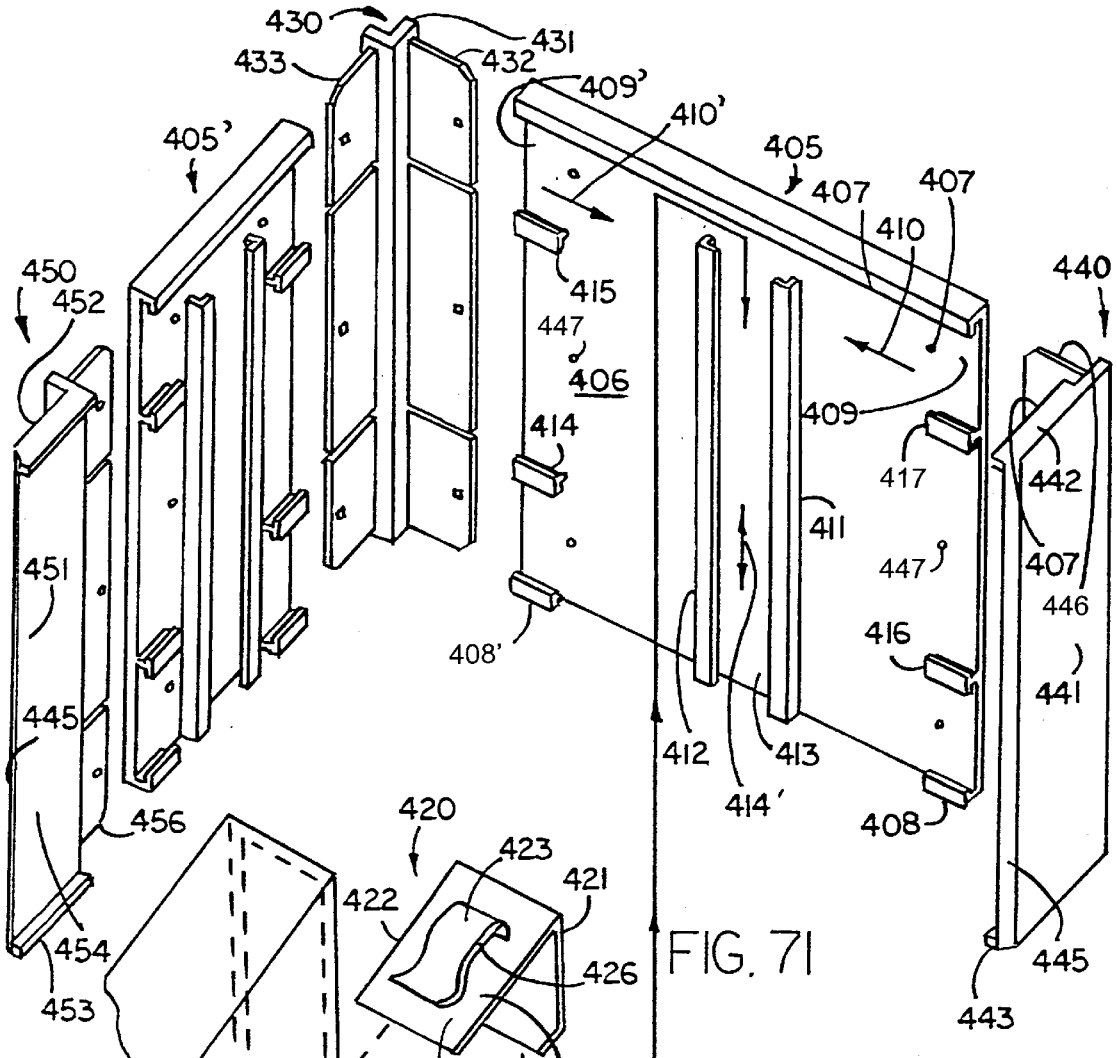
FIG. 71 is an exploded perspective view of the base end trim shown in FIG. 70.

Any of three different pieces can be attached to shoe 405, those pieces being extender piece or corner connector 430, 90 degree spat 440, and in-line spat 450 (FIG. 71). Corner connector 430 further allows connection to a second shoe 405, such as a two-inch wide shoe. This allows the trim to be extended around a two-inch panel-to-panel connector post. These five pieces 405, 405' 430, 440, and 450 can handle substantially any interconnection/condition of Plus wall and Zone wall panels when in off-module or in-line conditions.

The trim corner connector 430 (FIG. 71) is adapted to securely engage tracks 409 (or 409'). Specifically, the extender piece 430 includes an L-shaped body 431 having the same height as the shoe 405, and that is adapted to cover a vertical side edge of the shoe 405. Notably, the corner connector 430 can be inverted 180 degrees and used on either vertical side edge of the shoe. Corner connector 430 includes a series of blade flanges 432 and 433 that extend perpendicularly from the side edges of body 431. The first blade flanges 432 are configured to telescope into the tracks 409' in the lateral side edge of the shoe 405. The second blade flanges 433 extend generally perpendicularly to the first blade from body 431 and extend parallel the associated side surface of the cover panels 210, for connection to a second shoe 405 (or 405'), such as to span a panel-to-panel connector post or the like.

A 90° spat 440 (FIG. 71) is also provided for attachment to the shoe 405. (See FIG. 69) The 90 degree spat 440 (FIG. 71) includes a flat body 441 having top and bottom edge closeout flanges 442 and 443. The top and bottom edge closeout flanges 442 and 443 define a concavity 444 on the underside of the flat body 441. An angled leading edge 445 is formed on the flat body 441 for providing aesthetics where the spat 440 joins the base trim cover 401. A connector blade 446 extends perpendicular to the flat body 441, and is configured to telescopingly engage the track 409 (or 409') in the base trim shoe 405. Notably, spat 440 can be inverted and engaged with either side of shoe 405. Detent buttons 447 are provided on spat blade 446 (and on shoe 405) to ensure secure frictional engagement of spat 440 to shoe 405.

An in-line spat 450 (FIG. 71) is also provided for attachment to the shoe 405. The in-line spat 450 includes a flat body 451 having top and bottom edge closeout flanges 452 and 453 not unlike flanges 442 and 443 on spat 440. The top and bottom edge closeout flanges 452 and 453 define a concavity 454 on the underside of the flat body 451. An angled leading edge 455 is formed on the flat body 451 for providing aesthetics where the spat 450 joins the base trim cover 401. A connector blade 456 extends parallel but non-coplanar from the flat body 451, and is configured to mateably telescopingly engage the track 409 (or 409') in the base trim shoe 405. In-line spat 450 can be used to trim over a panel-to-panel connector post, or to bridge an L-shaped connection of a panel 101 to another panel 101.

To attach the lower trim 400 to the partition panel 101, the base trim cover panel 401 is initially attached to the floor channel 351 by pressing the "h" shaped portion of the base trim cover panel 401 (FIG. 63) onto the upwardly extending outer flange 359 (or 360) of the floor channel 351 (FIG. 71). The spring clip 420 of a selected shoe 405 is then clip-attached to an associated end of a partition frame 101, thus slidably holding the shoe 405 to the partition frame. Notably, the shoe 405 is vertically adjustable on the partition frame 101, and can be adjusted vertically against the floor. Selected spats 440 (or 450) are then attached to the shoe 405 by engaging a blade connector on the selected spat 440 (or 450) with an associated track 409 (or 409') on the shoe 405. With this arrangement, the base trim 400 slidably engages the partition frame 101 but stays with the floor channel 351 such that the partition frame 101 can be adjusted vertically with the levelers 391 without adversely affecting the appearance of the base of the partition system 100 along the floor.

UPPER TRIM ATTACHMENT TO PARTITION FRAME

Figure 76:
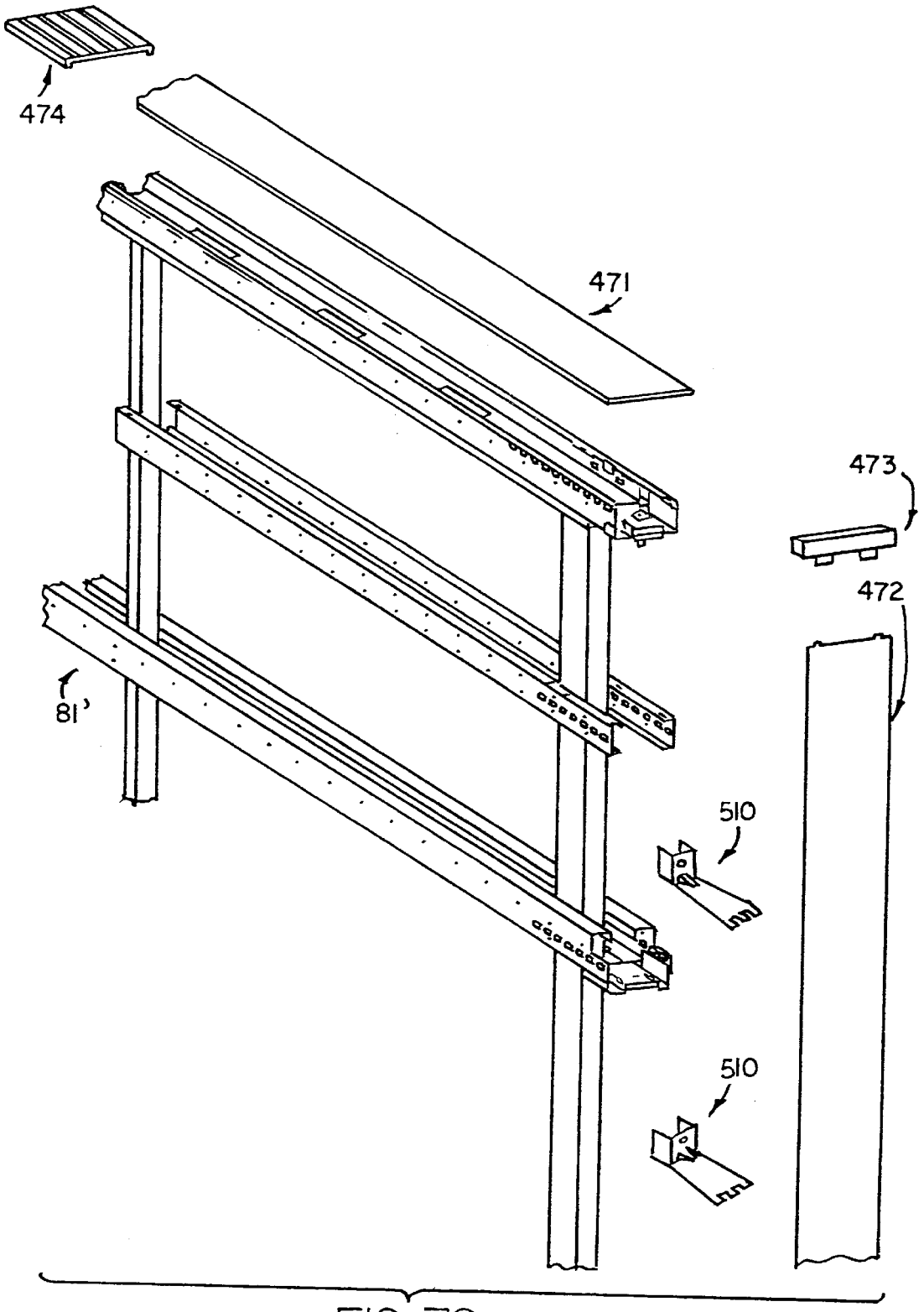
FIG. 76 is an exploded perspective view showing a four-inch Zone wall partition frame, extender brackets, and the upper trim including a top cap, an end cap, a spline, and a corner piece.
Figures 77, 78:
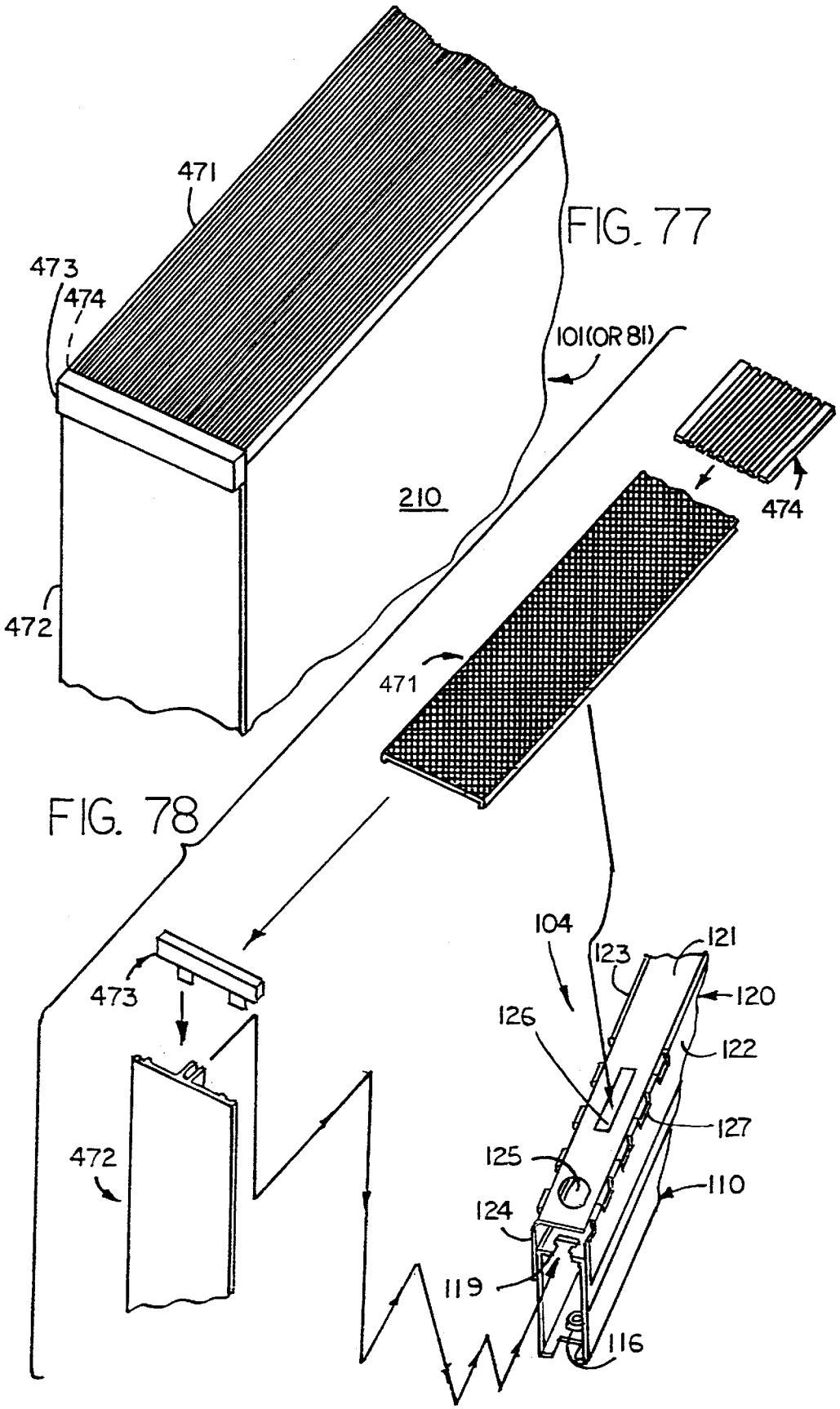
FIG. 77 is a perspective view showing an assembly of the components shown in FIG. 78.
FIG. 78 is an exploded perspective view of a two-inch Zone wall partition frame and the upper trim including a top cap, an end cap, a spline, and a corner piece.

The trim system includes a partition-attached upper trim system 470 that matches and aesthetically mates with the lower trim system 400 to further provide an aesthetic appearance. The upper trim system 470 includes a set of parts adapted to cover the four-inch Zone wall partition panel 81' (FIG. 76) and another set of parts adapted to cover the two-inch Zone wall partition panel 101 (FIGS. 77 and 78). The sets of parts are similar, such that the description hereinafter focuses on only the trim system for the two-inch partition frame 101 to reduce redundant discussion, it being understood that different sizes of trim can be easily constructed using the features described below.

The upper trim system 470 (FIGS. 87 and 88) includes a family of interconnectable components for aesthetically trimming out/covering a Zone Wall partition frame, including an extruded top cap 471, an extruded end cap 472, a rectangular corner piece (RCP) 473, and a spline 474.

Figure 93:
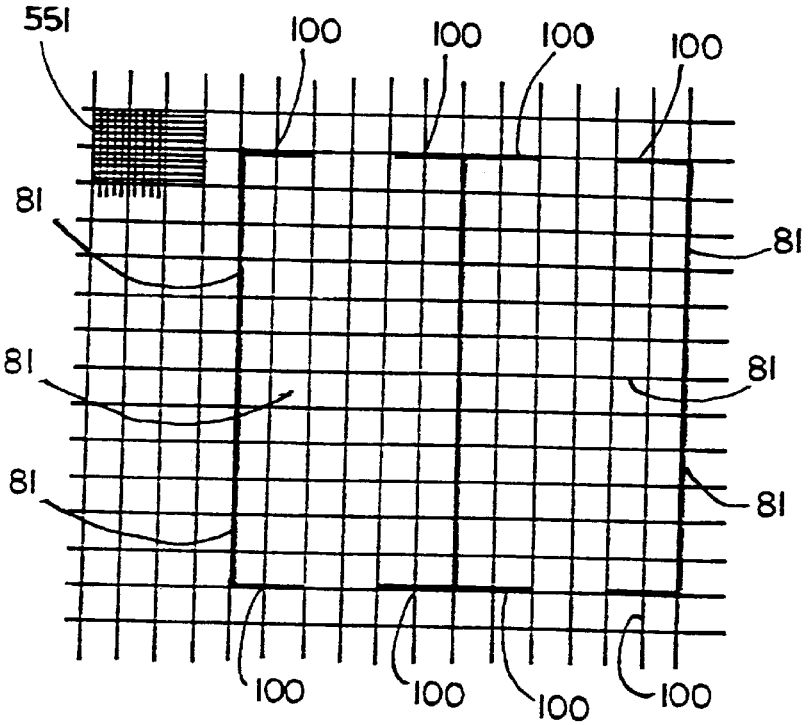
FIG. 93 is a schematic plan view showing the floor plan layout dimensional envelope strategy of the partition system, including the grid drawn on the building floor.

The top cap 471 (FIG. 93) comprises a polymeric extrusion having a flat top panel 475 with a plurality of spaced apart pairs of attachment legs 476 and 477 extending perpendicularly downwardly from a middle of the lower side of the flat top panel 475. The top surface 478 of the top cap can be decorated in various ways, including texturing its upper surface, covering the upper surface with fabric or upholstery material, or coating/treating the top cap in other ways known in the trade. A pair of opposing edge lips 479 and 480 are formed along the edges of the flat top panel 475. An inwardly extending ridge 481 and 482 is formed along the inside surface of each edge lip 479 and 480, the ridges 481 and 482 forming connector tracks 483 that is telescopingly engageable by the spline 474, as discussed below. The top cap 471 is initially extruded with two parallel longitudinally extending flanges, but several portions of the longitudinally extending flanges are optionally cutaway from the flat top panel to form the spaced apart pairs of attachment legs 476 and 477. Legs 476 and 477 have a length and location generally corresponding to the slots 126 in the top of the top horizontal frame member 104 on the two-inch Zone wall partition frame 101. Alternatively the longitudinally extending flanges can be left intact, so that they engage the inwardly facing opposing sides of the channel on top of the four-inch Zone wall partition frame 81 (FIGS. 29 and 88). Barbs or hooks 484 and 485 are formed on the ends of the attachment legs 476 and 477 to increase the retention strength provided by the attachment legs 476 and 477 when engaged with the frame member 104. Stops 486 and 487 are formed on the attachment legs 476 and 477 at an intermediate location on the attachment legs to prevent overtravel when the attachment legs 476 and 477 engage the partition frame 101.

The top cap 471 (FIG. 78) is attached to Zone Wall partition frame 101 by initially extending the attachment legs 476 and 477 into the mating slots 126 on top frame member 104 of the Zone wall partition frame 101. The top cap 471 is pressed downwardly into secure frictional engagement, at which time the attachment legs 476 and 477 securely engage the frame member 104, and the edge lips 479 and 480 overhang the upper edge of the cover panel 210 attached to the partition frame 101. A space/slit is provided between the edge of top cap 471 and the top of the adjacent cover panel 210 to provide access to slots 127/129 along the upper edge of frame 101.

The end cap 472 (FIGS. 79 and 80) comprises a polymeric extrusion having a flat laterally facing panel 490 with a pair of spaced apart continuous attachment flanges 491 and 492 extending perpendicularly sidewardly from a middle of the inside of the flat top panel 490. Each attachment flange 491 and 492 has a hook-shaped end 493 for securely engaging barbed notches 117, 118, 143, and 144 on the ends of the partition frame 101, as discussed below. The outwardly facing side surface 494 of the end cap 472 can be decorated in various ways, including texturing its outer surface, covering the outer surface with fabric or upholstery material, or coating/treating the end cap in other ways known in the trade. A pair of edge lips 495 and 496 are formed along the edges of the flat laterally facing panel. A pair of protruding ridges 497 and 498 are formed on the inside surface of the flat panel 490 at locations spaced from the edge lips 495 and 496. The ridges 497 and 498 include angled surfaces 499 and 500 that face inwardly toward each other so that they form a pair of connector tracks 501 and 502 with the root of the attachment flanges 491 and 492. The roots of attachment flanges 491 and 492 are enlarged to provide stops 503 and 504, the existence of which reduces the likelihood of overtravel as the attachment flanges 491 and 492 engage the notches 117, 118, 143, and 144 on the partition frame.

Figure 89:
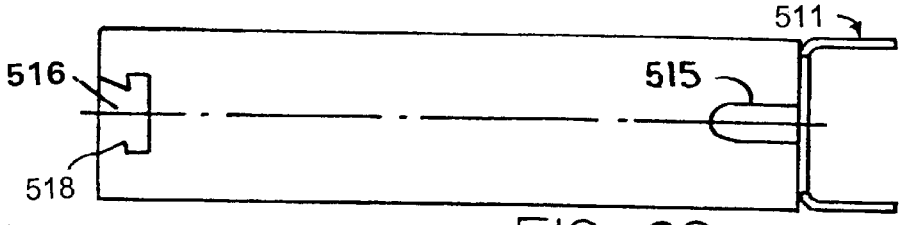
FIGS. 89–91 are orthogonal views of the extender bracket for use with the two-inch Zone wall shown in FIG. 2.
Figure 91:
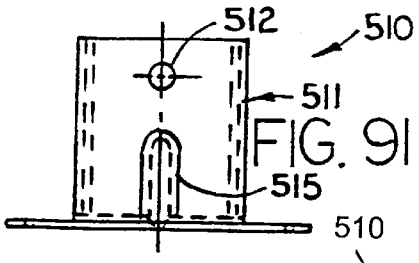
Figure 90:
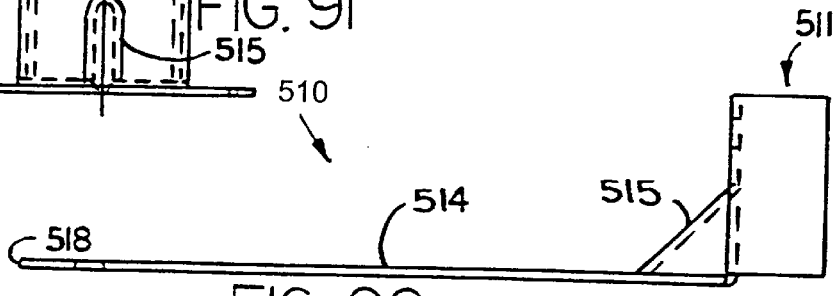

A bracket extender 510 (FIGS. 89–91) for supporting end cap 472 includes a horizontally open U-shaped end section 511 configured to mateably engage the tubular upright 102 (or 103) on partition frame 101. A hole 512 is formed in end section 511 for receiving an attachment screw to secure bracket extender 510 to upright 102 (or 103). Optimally, a self drilling/tapping screw is used so that the extender 510 can be located at any desired height on upright 102 (or 103). Optionally, adhesive can be used instead of a screw. A horizontally extending leg 514 extends from U-shaped end section 511 and is rigidified by an angled reinforcement web/gusset 515. Two notches 516 and 517 are formed in the end of leg 514 for engaging the attachment flanges 491 and 492 on end cap 472. By attaching several bracket extenders 510, the end cap 472 can be satisfactorily supported in an aligned position. The ends of frame members 104–109 and also the end 518 of bracket extender 510 engage the stops 503 and 504 (FIG. 80) on the underside of the flat panel 490 of end cap 472 to prevent twisting of end cap 472.

To assemble end cap 472 to the Zone wall partition frame 101, the attachment flanges 491 and 492 of end cap 472 are initially aligned with the notches 117, 118, 143, and 144 on the ends of the horizontal frame members 104–109 on the partition frame 101 and with the end notches in any extender brackets 510. Then the end cap 472 is pressed against the frame 101 so that the attachment flanges 491 and 492 mateably engage and become secured to frame 101 at the notches.

The rectangular corner piece (RCP) 473 (FIGS. 83–86) configured to join top cap 471 and end cap 472 at a corner includes a concave body 520 having an outer shape that corresponds to the outer cross sectional shape of the top cap 471. The body 520 defines a recess 521 bounded by top and bottom walls 522 and 523, and stepped side walls 524 and 525. The side walls 524 and 525 define a track 526 for receiving an edge of a spline 474, and further include opposing friction ledges 527 and 528 to help retain the spline 474 therein in a secure and aligned position. A pair of legs 529 and 530 extend downwardly from the body 520. The legs 529 and 530 are generally rectangularly shaped but include an angled surface 531 such that they are configured to mateably telescopingly engage the tracks 501 and 502 defined in the end trim cap 472.

The spline 474 (FIGS. 87 and 88) configured to join aligned top caps 471 each of which include a plate-like body 535 having a top surface 536 with a plurality of elongated square grooves 537 formed therein for aesthetics. Opposing edge flanges 538 and 539 are formed at the edges of the plate-like body 535. The spline 474 has a cross sectional shape configured to mateably engage and fit within the recess in the ends of top caps 471 for interconnecting a pair of aligned top caps 472. The grooves 540 and 541 formed on the edge flanges 538 and 539 are adapted to mateably engage the mating ridges 481 and 482 on each top cap 471. Angled corners 542 and 543 on the edge flanges 538 and 539 facilitate assembly of the spline 474 into the top cap 471.

The upper trim 470 can be attached to the partition frame 101 in various sequences. In one method, the partition-attached upper trim 470 is attached by initially extending the spline 474 into an end of partially installed a top cap 471. A second top cap 471 is then attached to the spline 474. The top caps 471 are then attached to partition frame 101 with their legs 476 and 477 fitting into the holes 126 in the top of the partition frame 101. An RCP 473 is attached to the end cap 472, and the end cap 472 is then attached to the vertical side edge of the partition frame 101. The free end of an associated top cap 471 is extended into the recess 521 of the RCP 473, as the RCP 473 is pressed into place. For off-module partition frame connection, a top cap 471 is attached to the top of a main partition frame 101, and a second top cap 471 is attached to the top of the off-module partition frame 101, the second top cap 471 including an end positioned in abutting contact with a side of the first top cap 471 on the main partition frame 101.

FOOTPRINT/DIMENSIONAL ENVELOPE STRATEGY

The present furniture construction system 80 includes panels with trim with outer dimensions that, when interconnected, meet a footprint envelope strategy defined as follows. The "footprint/dimensional strategy" of the present system is best understood by envisioning a building space subdivided into a matrix of orthogonally related lines 551 (FIGS. 92 and 93) on a horizontal plane, each spaced apart a unitary distance 552, such as one inch apart. The intersection of lines defines a gridwork of strategic points 553. The present partition systems 81, 82, 83, and 100 are constructed so that the partition systems include the following key features. All partition frames have vertical longitudinal central planes 554 (or 555) that, when the panels are interconnected, lie on one of the lines 551. All partition panels when covered with skins and trim also have outer surfaces that lie on or closely adjacent one of the lines 551 in plan view. All attachment bracketry (e.g. bracket 169 of FIG. 22 and bracket 190 of FIG. 28), when engaged with the attachment slots on the panel frames, define point-specific attachment locations that place the vertical longitudinal central planes 554 along one of lines 551 and also place the ends of the connected panels exactly on the strategic points 553.

Figure 92:
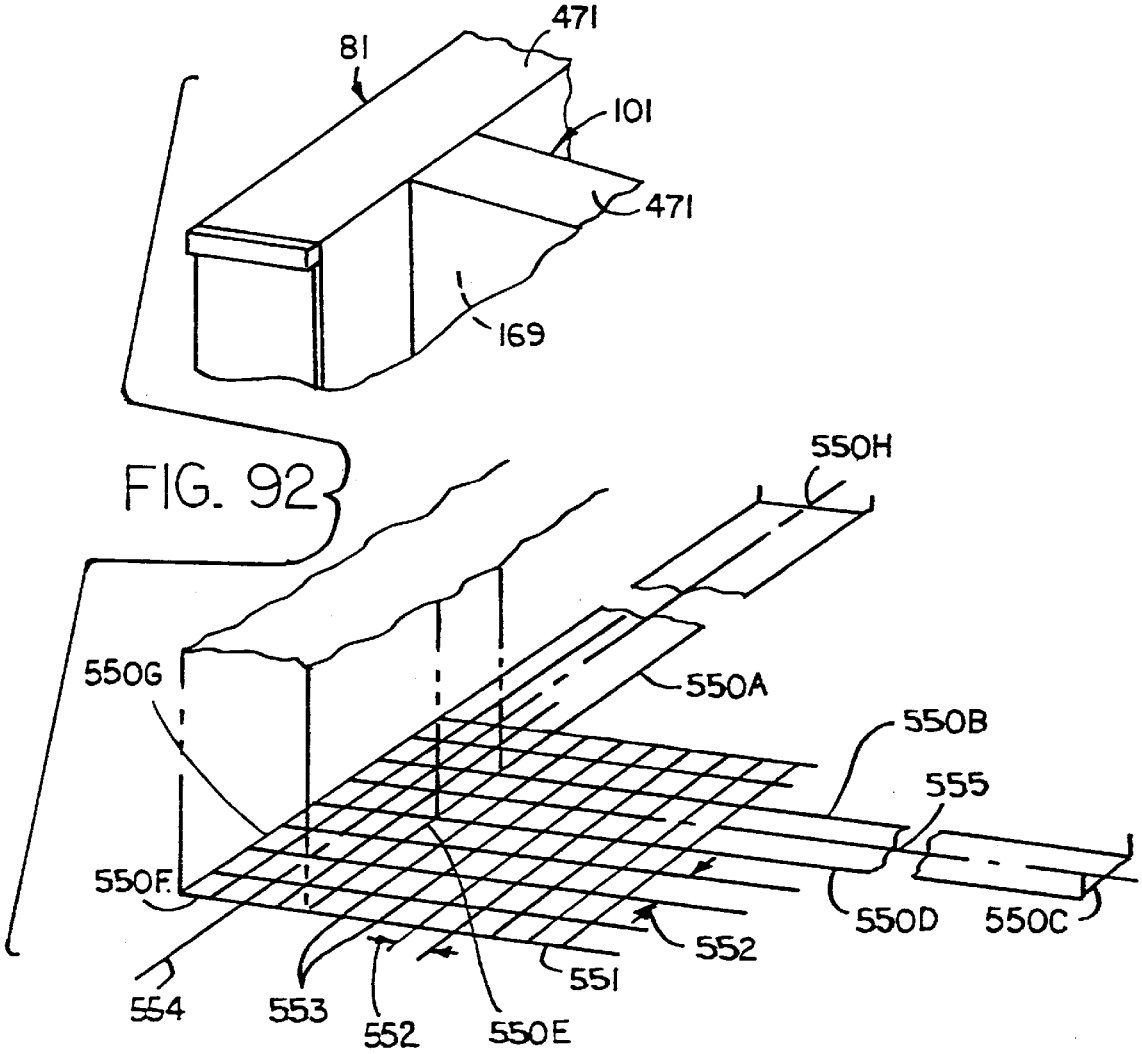
FIG. 92 is a schematic fragmentary view showing the floor plan layout dimensional envelope strategy of the partition system, including a grid drawn on the building floor.

For example, the vertical longitudinal central plane 554 of a partition frame 81 is shown in FIG. 92. The top cap 471 is securely held in a defined position on the frame 81 so that, in plan view, the outer surfaces of the top cap and of frame 81 lie along lines 550A, 550G, 550F, and 550H. As illustrated, the edges of the four-inch top cap 471 are located exactly 2.000 inches from the central plane 554. Notably, the cover panels 210 on the four-inch frame 81 have exterior surfaces that are located about 1.900 of an inch from the central plane 554, but the base trim cover 401 attached over the skins is about 0.100 of an inch thick such that its outer surface is positioned very close to a distance of 2.000 inches from the central plane 554 when base trim cover 401 is attached to frame 81. The end of a panel frame 101 is located exactly on a grid line 551. Attached to the illustrated frame 81 is an off-module attached two-inch frame 101. The central plane 555 of frame 101 is located on one of lines 551. Its top cap 471 is attached to frame 101 so that, in plan view, the edges of the two-inch top cap 471 and of frame 101 lie along lines 550A, 550B, 550C, and 550D.

Figure 74:
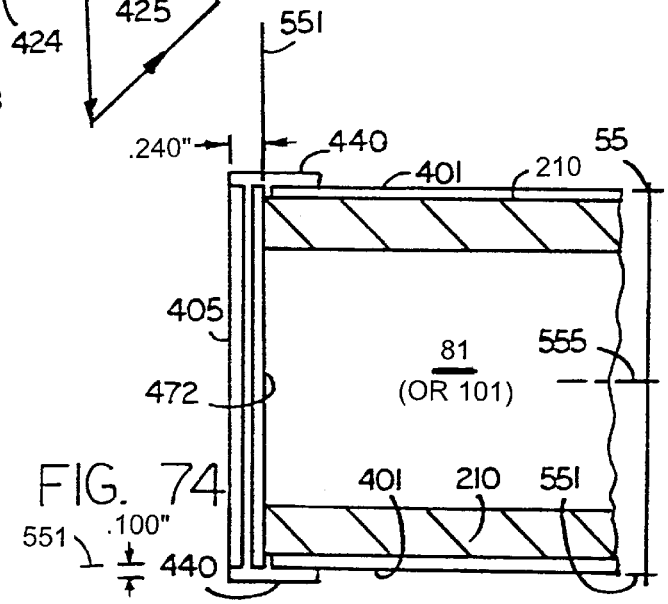
FIG. 74 is a cross-sectional view taken along line LXXIV—LXXIV in FIG. 69.

Notably, when end cap 472 is attached to frame 81 (FIG. 74) the exterior surface of the end cap 472 is located about 0.100 of an inch beyond the end of the partition frame 81 such that it is spaced about 0.100 of an inch beyond a grid line 551. Also, the exterior surface of the base shoe 405 is located about 0.240 of an inch beyond a grid line 551 (FIG. 74). Also, some surfaces of the RCPs 473 extend outboard of the four-inch envelope. However, each surface that extends outboard of the footprint/dimensional envelope strategy occurs at a location where there are no conflicting/dimensionally interfering parts. Specifically, it is noted that the RCPs 473 would be removed if there was another panel to be attached to the end of the existing panel. Further, the end trim 472 and base end trim shoes 405 are removable. Still further, the RCPs 473 and the base shoes 405 are constructed to accentuate the square/clean architectural appearance with lower base trim and upper trim.

Figure 7:
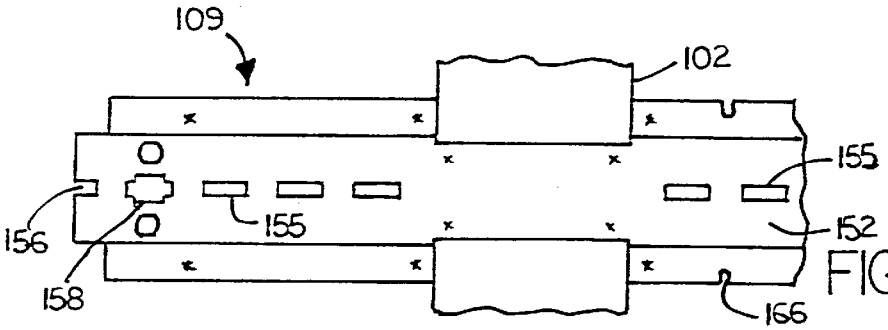

Thus, the primary outer surfaces of the top cap 471, and base trim cover 401 stay within a predetermined envelope dimension or "footprint" in plan view. By staying within the envelope, creep is substantially eliminated, even though some panels are attached in an off-module position. The envelope dimensions are dictated by a basic unit dimension. In the present system designed for English-measurement countries, the basic unit dimension is one inch. The envelope dimension for the partition panel is a multiple of the basic unit dimension. For example, the thickness of a partition panel may optimally be two-inch, four-inch, six-inch or eight-inch. Optimally, the thickness of a partition panel is an integer achieved by doubling the basic unit dimension one or more times, such as two-inch, four-inch, or eight-inch. The length of the partition panel is also a multiple of the basic unit dimension. Optimally, the slots are spaced one inch apart, and a half slot 156 is formed at a horizontal end of the partition frame (see FIG. 7) so that the center point of the slots is located exactly at an end of the frame. Whenever off-module partition panels are connected to another partition panel, their central plane falls exactly at the middle of one of the slots, and the points on the central planes 554/555 corresponding to each attachment slot on the panels fall on the X-Y matrix of attachment points 553 on the intersecting lines 551 of the footprint/dimensional strategy. This provides exact positioning of partition panels in the building space without measurement even when partition panels are positioned "off-module". This eliminates creep, which is a constant problem in panel systems, particularly those that include off-module partition panels.

Thus, a partition construction is provided that includes a partition frame having opposing vertical edges and a plurality of horizontal frame members that fits into a footprint/dimensional strategy that eliminates creep, even in off-module arrangements of partition panels. The frame members each define one or more rows of configured apertures, slots, and holes extending horizontally between the vertical edges. The configured apertures are "+" or "T" shaped, and include at least a smaller lower section and an enlarged middle section. Cover panels are attached to the partition frame by top locator/connectors that engage the smaller lower section of selected apertures, and by bottom connectors that engage an upper one of the holes. The cover panels are shaped to leave the enlarged middle section of the aperture open, so that it can receive a bracket for connecting a furniture component or an "off-module" partition frame to the first-mentioned partition frame. A U-shaped "off-module" connector is provided for interconnecting an "off-module" partition frame to another partition frame. The U-shaped off-module connector has a pair of legs defining a pair of opposing hooks for engaging the enlarged middle section of a selected one of the apertures in a primary partition frame. A rear section of the U-shaped off-module connector is configured for connection to the end of the off-module partition frame. The partition construction also includes a pair of leveling members each including downwardly disposed end sections. A floor channel is provided having a floor-engaging wall and a locking wall spaced above the floor-engaging wall. The locking wall includes key hole shaped apertures having a large end for vertically receiving the end sections of the leveling members and further having a small end for horizontally interlockingly receiving the end sections. The locking wall includes marginal material around the small end for engaging an interlock recess on the end sections of the leveler.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A partition system comprising:

a frame having a pair of closely spaced apertures; and a cover panel having a locator tab engaging one of the pair of apertures and an antidislodgement tab separate from the locator tab and spaced therebelow engaging the other of the pair of apertures, respectively, the locator tab and the antidislodgement tab both projecting outwardly from the cover panel and both being configured to engage the frame from a front of the frame, the cover panel further including a body covering the frame when the cover panel is attached to the frame, the antidislodgement tab being configured to fit into the other of the pair of apertures from the front of the frame after the locator tab is engaged in the one of the pair of apertures as the cover panel is rotated about the locator tab from an angled position on the frame to a vertical position against the frame.

2. The partition system defined in claim 1 wherein the locator tab is hook shaped.

3. The partition system defined in claim 2 wherein the antidislodgement tab extends horizontally and linearly.

4. The partition system defined in claim 1 wherein the locator tab and the antidislodgement tab comprise bent flanges integrally formed from a single section of sheet material.

5. A partition construction comprising:

a first partition frame having opposing vertical side edges and at least an upper and a lower horizontal frame member extending between the vertical side edges, each of the upper and lower frame members each defining a row of apertures spaced horizontally apart, some of the apertures in the upper row being formed as part of a configured aperture defining a smaller-sized lower section and an enlarged upper section connected to the lower section;

a cover panel including a covering part shaped to cover at least a portion of the partition frame, the cover panel including a pair of upper connectors engaging the smaller-sized lower section of selected ones of the configured apertures while providing access to the enlarged section of the configured apertures in the row of apertures, the cover panel further including a lower connector retaining a bottom portion of the cover panel to the lower frame member; whereby the enlarged section of the configured apertures in the upper frame member is accessible and engageable by a bracket for supporting a furniture component even when the cover panel is attached to the partition frame.

6. The partition construction defined in claim 5 including third apertures located below the configured apertures in the upper frame member.

7. A partition frame comprising:

a pair of tubular uprights that are spaced apart, each having opposing spaced apart faces and also top and bottom ends;

at least one pair of hat-shaped channels positioned on opposite sides of said tubular uprights and at a common height, the hat-shaped channels extending horizontally and including a pair of notches receiving half of the tubular uprights, each of the hat-shaped channels including a center flange and a pair of wing flanges that are parallel but non-coplanar with the center flange, the center flange abutting the tubular uprights at the notches and the wing flanges being cut away at the notches, the wing flanges of the hat-shaped channels being secured together and each center flange secured to the tubular uprights to form a rigid construction.

8. The partition frame defined in claim 7 including a top frame member and a bottom frame member extending horizontally and connecting the top ends and the bottom ends, respectively.

9. The partition system defined in claim 7 wherein center flanges of the hat-shaped channels define a horizontally-extending row of slots.

10. The partition system defined in claim 7 wherein the hat-shaped channels include side flanges that extend perpendicularly between edges of the center flange and the wing flanges, the notches extending at least partially into the side flanges.

11. The partition system defined in claim 10 wherein the notches extend completely through the side flanges and to the center flange.

12. A partition construction comprising:

a first partition frame having opposing vertical edges and at least one elongated horizontal frame member extending between the vertical edges, the at least one horizontal frame member defining a row of apertures spaced horizontally apart, the apertures defining a smaller-sized lower section and an enlarged upper section connected to the lower section;

a cover panel having a covering part shaped to cover at least a portion of the partition frame, and a pair of connectors attached to the covering part and engaging the smaller-sized lower sections of selected ones of the apertures, the covering part providing access to the enlarged section of the apertures in the row of apertures when attached to the partition frame; and a bracket having a front section engaging a selected one of the enlarged sections of the apertures, the bracket also having a laterally extending rear section adapted to support one of a furniture component and another partition frame.

13. The partition construction defined in claim 12 wherein some of the apertures have a T shaped section.

14. The partition construction defined in claim 12 wherein some of the apertures are plus shaped.

15. The partition construction defined in claim 12 wherein the horizontal frame member includes a vertical planar flange forming a side of the frame member, the apertures being located in the vertical planar flange.

16. The partition construction defined in claim 12 wherein the horizontal frame member includes slots along with the row of apertures, the slots and the apertures forming a repeating pattern across a length of the horizontal frame member so that the cover panels can be selectively located on the horizontal frame member.

17. A partition construction comprising:

a first partition frame having opposing vertical edges and at least one elongated horizontal frame member extending between the vertical edges, the at least one horizontal frame member defining a row of accessible apertures spaced horizontally apart, the first partition frame further including at least one cover panel partially covering the at least one horizontal frame member but providing horizontal access to said row of apertures;

a second partition frame having a vertical side edge positioned proximate the first partition frame in an off-module position between the vertical edges of the first partition frame, the second partition frame including at least another horizontal frame member having an end positioned proximate the at least one horizontal frame member; and a U-shaped off-module connector having a pair of legs defining a pair of horizontally facing opposing hooks engaging a selected one of the apertures and a rear section connecting the legs, the rear section being connected to the vertical side edge of the second partition frame.

18. The partition system defined in claim 17 wherein said legs and said rear section lie in different planes.

19. The partition system defined in claim 17 wherein said legs are movable between a frame-engaged position and a frame-disengaged position.

20. The partition system defined in claim 17 wherein said rear section is resilient.

21. The partition system defined in claim 20 wherein said legs define a space therebetween for closely receiving an attachment screw for attaching the off-module connector to the second partition frame such that the legs are held apart by the attachment screw and cannot be released from the selected one aperture.

22. The partition system defined in claim 21 wherein said legs and said rear section lie in different planes.

* * * * *

US005816001B1

REEXAMINATION CERTIFICATE (4101st)

United States Patent [19]

[11] B1 5,816,001

Goodman et al.

[45] Certificate Issued Jun. 6, 2000

[54] PARTITION CONSTRUCTION INCLUDING INTERCONNECTION SYSTEM AND REMOVABLE COVERS

[75] Inventors: Steven F. Goodman, Wyoming; Michael J. Feldpausch; Jeffrey A. Musculus, both of Hastings, all of Mich.

[73] Assignee: Steelcase Inc., Grand Rapids, Mich.

Reexamination Request:
No. 90/005,491, Sep. 10, 1999

Reexamination Certificate for:

| | |
|---|---|
| Patent No.: | **5,816,001** |
| Issued: | **Oct. 6, 1998** |
| Appl. No.: | **08/687,724** |
| Filed: | **Jul. 26, 1996** |

[51] Int. Cl.[7] ..... E04B 2/78; E04B 2/82

[52] U.S. Cl. ..... 52/239; 52/36.1; 52/36.6; 52/220.7; 52/284; 52/481.2; 52/489.2; 52/653.1

[58] Field of Search ..... 52/36.1, 36.4, 52/36.5, 36.6, 220.7, 239, 281, 284, 474, 479, 481.1, 481.2, 483.1, 489.1, 489.2, 653.1, 656.1, 775, 781; 108/106, 107, 108; 312/265.2, 265.3

[56] References Cited

U.S. PATENT DOCUMENTS

| | | |
|---|---|---|
| 3,425,568 | 2/1969 | Albright . |
| 3,514,883 | 6/1970 | Albright . |
| 4,619,486 | 10/1986 | Hannah et al. . |
| 4,883,330 | 11/1989 | Armstrong et al. . |

OTHER PUBLICATIONS

Exhibit A is a brochure entitled *Knoll—Hannah Desk System*, 18 pages, dated Oct. 1986.

Exhibit B is a brochure entitled *Knoll—Hannah Desk System*, 13 pages, undated but published in 1986.

Exhibit C is a publication entitled *Knoll—Hannah Desk System—Electrical Assembly Guide*, (12 pages), undated but published in 1986.

Exhibit D is a publication entitled *Knoll—Hannah Desk System—Assembly Guide*, 12 pages, undated but published in 1986.

*Primary Examiner*—Carl D. Friedman

[57] ABSTRACT

A partition construction includes a partition frame having opposing vertical edges and upper and lower frame members each defining a repeating pattern of configured apertures and holes extending horizontally between its vertical side edges. The configured apertures are "+" or "T" shaped, and include at least a smaller lower section and an enlarged middle section. Cover panels are attachable to the partition frame by top locator/connectors that engage the smaller lower section of selected apertures in the upper frame member, and by bottom connectors that engage an upper one of the holes in the lower frame member. The cover panels are shaped to leave the enlarged middle section of the configured apertures open, so that they can receive a component-supporting bracket or an off-module partition supporting bracket to the primary partition frame. A U-shaped "off-module" connector is provided having a pair of hooked legs for engaging a selected one of the apertures in the enlarged middle section thereof, and a rear section configured for connection to the end of an off-module partition frame. The partition frame includes a pair of leveling members each including downwardly disposed end sections. A floor channel is provided having a locking wall spaced above a floor-engaging wall. The locking wall includes key hole apertures having a large end for vertically receiving the end sections of the leveling members and further having a small end for horizontally receiving the end sections of the leveler. The locking wall includes marginal material around the small end for engaging a recess on the end sections of the leveler to retain the leveler in the key hole apertures.

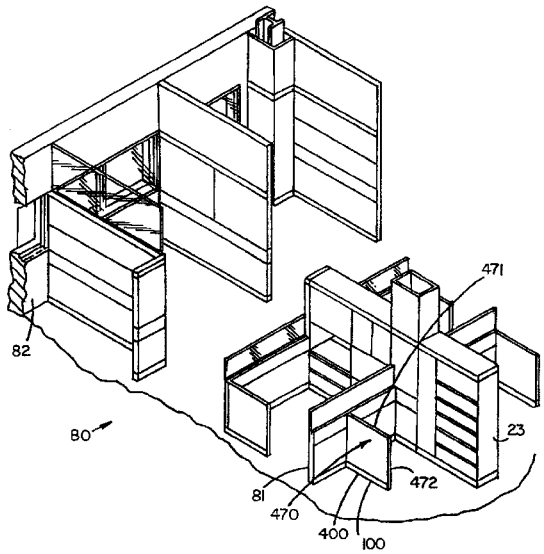

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–22 is confirmed.

* * * * *